US008214945B2

(12) United States Patent
Walker

(10) Patent No.: US 8,214,945 B2
(45) Date of Patent: Jul. 10, 2012

(54) UNIVERSAL PATIENT LIFTING FRAME

(75) Inventor: Simon Christopher Dornton Walker, Leicestershire (GB)

(73) Assignee: Life Lift (Medical Products) Limited, Rothley, Leicestershire ( * ) Notice: Subject to any disclaimer, the term of this patent is extended or adjusted under 35 U.S.C. 154(b) by 0 days.

(21) Appl. No.: 13/016,132

(22) Filed: Jan. 28, 2011

(65) Prior Publication Data

US 2011/0126351 A1 Jun. 2, 2011

Related U.S. Application Data

(63) Continuation of application No. PCT/GB2009/001873, filed on Jul. 31, 2009.

(30) Foreign Application Priority Data

Jul. 31, 2008 (GB) ..... 0813956.0
Jan. 29, 2009 (GB) ..... 0901467.1

(51) Int. Cl.
*A61G 7/12* (2006.01)

(52) U.S. Cl. ..... 5/83.1; 5/85.1; 5/87.1; 5/89.1

(58) Field of Classification Search ..... 5/81.1 R, 5/83.1–87.1, 89.1
See application file for complete search history.

(56) References Cited

U.S. PATENT DOCUMENTS

| | | | | |
|---|---|---|---|---|
| 2,792,052 | A * | 5/1957 | Johannesen | 297/5 |
| 3,568,226 | A * | 3/1971 | Mater et al. | 5/87.1 |
| 3,608,104 | A | 9/1971 | Gerven | |
| 4,409,696 | A | 10/1983 | Bakker | |
| 4,446,587 | A | 5/1984 | Jump | |
| 4,510,633 | A | 4/1985 | Thorne | |
| 4,704,749 | A * | 11/1987 | Aubert | 5/87.1 |
| 5,325,550 | A | 7/1994 | Dearstyne et al. | |
| 6,105,184 | A * | 8/2000 | Onishi | 5/89.1 |
| 6,192,534 | B1 * | 2/2001 | Restivo | 5/89.1 |
| 6,568,003 | B1 * | 5/2003 | Vest | 5/89.1 |
| 7,287,288 | B2 * | 10/2007 | Walker | 5/89.1 |
| 7,424,756 | B2 * | 9/2008 | Van Raemdonck | 5/81.1 R |
| 7,921,486 | B2 * | 4/2011 | Biersteker et al. | 5/87.1 |
| 2004/0074414 | A1 * | 4/2004 | Phillips | 104/93 |
| 2005/0217024 | A1 | 10/2005 | Aarestad | |
| 2006/0080775 | A1 * | 4/2006 | McWattie et al. | 5/89.1 |
| 2007/0094791 | A1 | 5/2007 | Walker | |
| 2009/0119835 | A1 * | 5/2009 | Liljedahl | 5/87.1 |
| 2011/0056019 | A1 * | 3/2011 | Altena et al. | 5/87.1 |
| 2011/0083267 | A1 * | 4/2011 | Gibson et al. | 5/87.1 |

FOREIGN PATENT DOCUMENTS

| | | | |
|---|---|---|---|
| DE | 85 27 201.9 | U1 | 3/1986 |
| DE | 43 13 494 | A1 | 10/1994 |
| EP | 1 169 989 | A2 | 1/2002 |
| FR | 2 287 211 | | 10/1974 |
| FR | 2636232 | A1 | 3/1990 |
| FR | 2861584 | A1 | 5/2005 |

(Continued)

*Primary Examiner* — Michael Trettel
(74) *Attorney, Agent, or Firm* — Reinhart Boerner Van Deuren P.C.

(57) ABSTRACT

The invention relates to a patient lifting frame for use with an invalid hoist for lifting and supporting an invalid patient. Such a lifting frame can be used in conjunction with a wheeled or overhead mechanical or electrical hoist unit, to assist nursing staff, healthcare staff or carers in lifting and moving disabled patients. This lifting frame may also be used in many different areas to carry able bodied people in safety for operations such as air sea rescue service.

16 Claims, 26 Drawing Sheets

FOREIGN PATENT DOCUMENTS

| | | | |
|---|---|---|---|
| GB | 757340 | | 9/1956 |
| GB | 2 105 677 | A | 3/1983 |
| GB | 2396147 | A | 6/2004 |
| WO | WO 84/02074 | A1 | 6/1984 |
| WO | WO 96/11658 | A1 | 4/1996 |
| WO | WO 2004/021951 | A2 | 3/2004 |

* cited by examiner

UNIVERSAL PATIENT LIFTING FRAME

CROSS-REFERENCE TO RELATED PATENT APPLICATIONS

This patent application is a continuation of pending PCT Application No. PCT/GB2009/001873, filed Jul. 31, 2009, which claims the benefit of Great Britain Application No. 0901467.1, filed Jan. 29, 2009, and Great Britain Application No. 0813956.0, filed Jul. 31, 2008, the entire teachings and disclosure of which are incorporated herein by reference thereto.

FIELD OF THE INVENTION

This invention generally relates to medical devices and more particularly to medical devices for transporting patients.

BACKGROUND OF THE INVENTION

Many such patients, whether in hospital or at home, need assistance in movement, for example between a bed and a chair, between a chair and a bath, between a bed or chair and a toilet area or between floor and bed. Whenever the patient is unable to support himself or herself, the movement of the patient has to be carried out by nursing staff, healthcare staff or carers who must manually lift and move the patient. This task can exceed the weight lifting limits generally recommended for one or even two persons, and often nursing staff, healthcare staff or carers themselves suffer from back damage or back strain. Much of this lifting work is also done by the family members of patients in their own homes.

It has become commonplace to use a wheeled or overhead hydraulic or electrical hoist to lift a patient from a bed, but this generally requires the patient to be placed in a sling to which the hoist may be attached. Such slings need to be placed beneath and around the patient before lifting commences, and in the case of a disabled patient unable to assist the carer, the patient still needs to be lifted manually and positioned over the sling, in order to fix the sling in a position from which lifting can commence. Even when lifting does commence, the sensation of being lifted in a canvas sling is often a source of great trauma for the patient, because the flexible canvas sling provides very little feeling of security for the patient. It is for this reason that many attempts have been made to provide a lifting frame which could be used with a hoist to lift a sitting patient. It has been much more of a challenge to design a frame to be used with a hoist to raise into a sitting position a patient who was lying face upwards on a bed. One such frame is disclosed in my Patent Specification GB-B-2396147 which discloses a lifting frame that can be used to raise a patient from a face-up prone lying position to a sitting position. The lifting frame of that granted Patent utilizes a balance effect between the patient's upper body and the patient's lower body. The weight of the upper body is taken by the patient support elements including side pads which engage beneath the armpits of the patient and against opposite sides of the patient's ribcage, and the weight of the patient's lower body is taken by support means which support the patient's upper legs or posterior. The patient's upper and lower body weights are supported on opposite sides of a pivotal mounting so that the above balance effect takes place. The patient can therefore be lifted from a bed using the patient lifting frame which is raised by a hoist, and can easily be moved to a sitting position.

US-A-2004/0074414 discloses a patient lifting frame for use with a lifting hoist, for lifting a patient from a sitting to a standing position and is for use in assisting the patient to walk and to exercise. That patient support frame is capable of moving a patient from a sitting to a standing position for working therapy, but is totally unsuitable for lifting a patient from a prone lying position to the sitting or standing position.

Patient lifting frames and slings may be used to lift patients who have a tendency to epilepsy or similar uncontrolled body movements. It is therefore of prime importance that the patient should not be able to damage himself or herself on the equipment. That is a principal reason why lifting frames have not been more widely adopted, and why slings, which are much more difficult to use and which register a high incidence of patient fear and intolerance, are still in widespread use. It is an object of the invention to provide a lifting frame that is suitable for use with epileptic patients as well as those who are not liable to fits but who nevertheless are not able properly to support their heads and limbs, as well as patients who can support and control their heads and limbs but whose body mass makes it impossible for nursing staff, healthcare staff or carers to lift them in a satisfactory manner at present. It is also an object of the invention that the lifting frame is capable of moving a patient easily between the face-up lying, sitting and standing positions.

In this specification the terms "up", "upper", "low", "lower", "above" and "beneath" are used with reference to the normal vertical attitude of a patient lifting frame when it is suspended from a patient lifting hoist. The terms "front", "back", "forwardly" and "rearwardly" are used with reference to the front and back of a patient supported by such a lifting frame.

SUMMARY OF THE INVENTION

Embodiments of the invention provide a patient lifting frame for use with an invalid hoist for lifting and supporting an invalid patient. The lifting frame comprises a pair of suspension side bars (1) each of which has an upper end portion and a lower end portion and which is provided at its upper end portion with a linkage (2) for connection to a spreader bar of the invalid hoist and at its lower end portion with a suspension mounting (4). Each suspension mounting (4) comprises a pivotal/rotary connector (4A) which is pivotally connected to an associated side bar (1) and which rotatably mounts a cantilever side bar assembly (4B). On one side of the pivotal axis of the pivotal/rotary connector (4A) there is connected a patient upper body support frame. On the other side of the pivotal axis of the pivotal/rotary connector (4A) there is connected a patient lower body support means (28,28') for engaging and supporting the posterior or upper legs of the patient. The patient upper body support frame comprises a pair of side frame elements (13,15,16) including patient underarm support elements (13) for passing beneath the armpits of the patient and a pair of padded side plates (15,16), one suspended from each of the said patient underarm support elements (13) of the side frame elements, which engage in use against opposite sides of the patient's ribcage and are drawn in against the ribcage by straps (29,33) connecting together the padded side plates (15,16). The patient upper body support frame further comprises a link bar assembly (9) connecting together the side frame elements. Each end of the link bar assembly (9) is connected to an associated one of the cantilever side bar assemblies (4B) through a universal joint (8), each universal joint (8) and link bar assembly (9) combination being such as to permit pivotal movement of each of the cantilever side bar assemblies (4B) relative to the link bar assembly (9) about three mutually perpendicular axes (X), (Y) and (Z).

Embodiments of the invention provide a patient lifting frame for use with an invalid hoist for lifting and supporting an invalid patient. Using the frame of one embodiment of the invention, the underarm support elements are positioned beneath the armpits of the patient, with the side plates and side pads engaging against opposite sides of the patient's ribcage. Webbing straps are then passed around the patient's body and around the side plates, so that tightening those straps draws the side plates and side pads close against the opposite sides of the patient's ribcage. That can be achieved either with the patient lying prone on his or her back or with the patient in a sitting or standing position.

Because the ends of the link bar assembly are connected to the suspension mountings through universal joints with three mutually perpendicular axes of pivotal movement, the versatility of the lifting frame is vastly increased over that of GB-B-2396147. When fitting the frame around a patient, the underarm support elements which pass beneath the armpits of the patient can if desired be positioned one at a time, and then the side pads can be closed together against the sides of the patient's ribcage in a subsequent motion, for example by tightening the webbing straps and/or shortening the full length of the link bar assembly. Most importantly, the universal joints permit the frame to move with the patient when fitted. If the patient is lifted in the frame for walking exercises the frame can twist and flex with patient movement, so that it permits the patient's shoulders, back and upper body to move unhindered to balance movement of the legs. That is in complete contrast to the lifting frame of US-A-2004/0074414 which provides no freedom of movement at all between the patient upper body support frame and the patient lower body support means.

Using a lifting frame according to one embodiment of the invention the patient can be lifted from a prone face-up position to a sitting position as described in GB-B-2396147, with the patient's weight being distributed between the upper body support frame and the lower body support means. Preferably the suspension mountings are attached to the suspension side bars as specified in claim 2 herein. As the patient is lifted from a prone position to a sitting position, the pivotal balance effect described in my GB-B-2396147 is then established, with the patient's lower body weight being supported on the means for engaging and supporting the posterior or upper legs of the patient, and the patient's upper body weight being taken by the patient underarm support elements and padded side plates. The suspension mountings, which pivotally suspend the patient upper and lower body support means, are thus preferably 2-axis pivotal/rotary connectors which are pivotally connected to the suspension side bars which rotatably mount the cantilever side bar assemblies which comprise first portions on one side of the pivotal axis of the connectors for supporting the patient's upper body weight and corresponding second portions on the other side of the pivotal axis of the connectors for supporting the patient's lower body weight. The result is that the support frame pivots freely around the suspension mountings when the patient is moved between a prone face-up position and a sitting position, or vice versa, just as described in GB-B-2396147.

The benefits of permitting the lifting frame to flex about the universal joints in response to a patient body movement are benefits which are felt by all patients, but those benefits are most apparent to observers when the patient being lifted suffers a convulsion, such as an epileptic fit or the involuntary movements of someone suffering from Parkinson's disease. The independent right and left hand movement of the universal joints of the lifting frame of this embodiment of the invention is of particular benefit in those circumstances. The universal joints permit the patient upper body support frame to follow both the independent vertical movements of the patient's shoulders and their independent forward-and-back movement during the convulsion, and by following the patient's movement the upper body support frame presents no injury risk to the patient. The lifting frame permits the fitting of a patient head and neck support means to support the head of a patient who does not have proper muscular control of his or her head and neck. It could be very dangerous for a head and neck support to hold a patient's head still while permitting movement of the shoulders and upper torso, since that could place an undue stress on the neck vertebrae. It has been found that the mounting of a head and neck support between resilient posts extending upwards from the rear edges of the side plates is a particularly effective head and neck support even for a lifting frame in which extended movement of the patient's shoulders and upper torso is matched by flexible movement of the lifting frame through the universal joints. When the patient's head is secured to such a head and neck support, for example using a strap or band around the patient's forehead, then movement of the patient's shoulders and upper body is successfully communicated to the head in such a manner that strain on the top vertebrae of the patient's spine is much reduced.

The lifting frame can be used to lift a variety of differently sized patients, from children to large and potentially bariatric adults, and to lift a variety of patients with different medical conditions including potentially convulsing patients and amputees. A slightly modified patient lower body support means may conceivably be required for double lower limb amputees, but the remainder of the lifting frame would need no modification at all. The side-to-side width of the potential range of patients is accommodated by the preferably telescopic or other width-adjustable nature of the link bar assembly which connects together the universal joints at the ends of the cantilever side bar assemblies, and the front-to back range of patient sizes can be accommodated by making the side plates and side pads interchangeable for side plates and side pads of different sizes. Advantageously the mounting points for the patient lower body support means are adjustable in the front-to-back direction to compensate for differently sized side plates and side pads, the better to maintain the equal and opposite moments imparted by the patient's upper and lower body weights during lifting.

Sometimes, however, the lifting frame is to be used to assist a patient in walking, for example during a physiotherapy session for a patient who has had a spinal or lower limb injury. For such a lifting operation the patient lower body support means must be detached and removed completely. The pivotal connections between the suspension side bars and the suspension mountings are then inappropriate, as the weight of the patient's upper body on the cantilevered side bar assemblies of the suspension mountings creates a moment that is not matched by an equal and opposite moment from the patient's lower body. To make such physiotherapy possible, the pivotal connection between each suspension side bar and its suspension mounting is preferably lockable to be held at a fixed angle, preferably with the cantilever side bar assemblies of the suspension mountings generally perpendicular to their suspension side bars. That locking may be established by a locking sleeve axially slidable on each suspension side bar between a lock releasing condition in which it is clear of the suspension mounting and does not interfere with the pivotal movement of the associated 2-axis pivotal/rotary connector relative to its suspension side bar, and a locking condition in which it surrounds the pivotal connection portion of the pivotal/rotary connector and prevents pivotal movement. Conveniently the locking sleeves are lightly held in each of the locking and lock releasing conditions by ball catches, to eliminate the possibility of inadvertent lowering of the locking sleeves over the pivotal/rotary connectors to their locking conditions. I call these locking sleeves kinematic locks, because the locking and unlocking of the pivotal coupling between the suspension side bars and the pivotal/rotary connectors is the result of a physical sliding movement of the locking sleeves. To engage the kinematic locks the patient is raised to a sitting position as previously described and then the kinematic locks are engaged so that the patient's lower body weight is no longer used to balance the suspension mountings about their pivotal axes. The patient lower body support means can then be removed, and the patient lifted to standing height for the walking exercise.

When the locking sleeves of the kinematic locks are in their locking condition the patient underarm supports which support the side pads strapped against the patient's sides are maintained generally perpendicular to the suspension side bars so that the suspension side bars are maintained generally in line with the patient's spine. No balance between the weights of the patient's upper and lower body then takes place during the physiotherapy session, although once the lower body support means are again attached the kinematic locks can be released to cause the lifting frame to revert to operation as described in GB-B-2396147.

It is believed that the kinematic locks are inventive in their own right. Embodiments of the invention accordingly also provide a patient lifting frame comprising:

two suspension side bars each connectable at an upper end to a spreader bar of an invalid hoist and at a lower end to a pivotal suspension mounting comprising a 2-axis pivotal/rotary connector supporting a cantilever side bar assembly of the lifting frame, each cantilever side bar assembly having a first cantilever portion on one side of its 2-axis pivotal/rotary connector and a second cantilever portion on the other side thereof, the first cantilever portions mounting patient underarm support elements for engaging beneath the armpits of a patient, which underarm support elements carry side plates and side pads for engaging against opposite sides of a patient's ribcage so that the underarm support elements and side pads form a patient upper body support means, the second cantilever portions having distal ends which are connected together by a link bar assembly and which detachably mount a patient lower body support means for passing beneath the patient's posterior or upper legs, characterised in that each 2-axis pivotal/rotary connector is selectively lockable to cancel its pivotal movement relative to its associated suspension sidebar, and to support the associated cantilever side bar without any equal and opposite balancing moment being applied to the second cantilever portions when the patient lower body support means is detached from the said second cantilever portions.

DETAILED DESCRIPTION OF THE DRAWINGS

Figure 1:
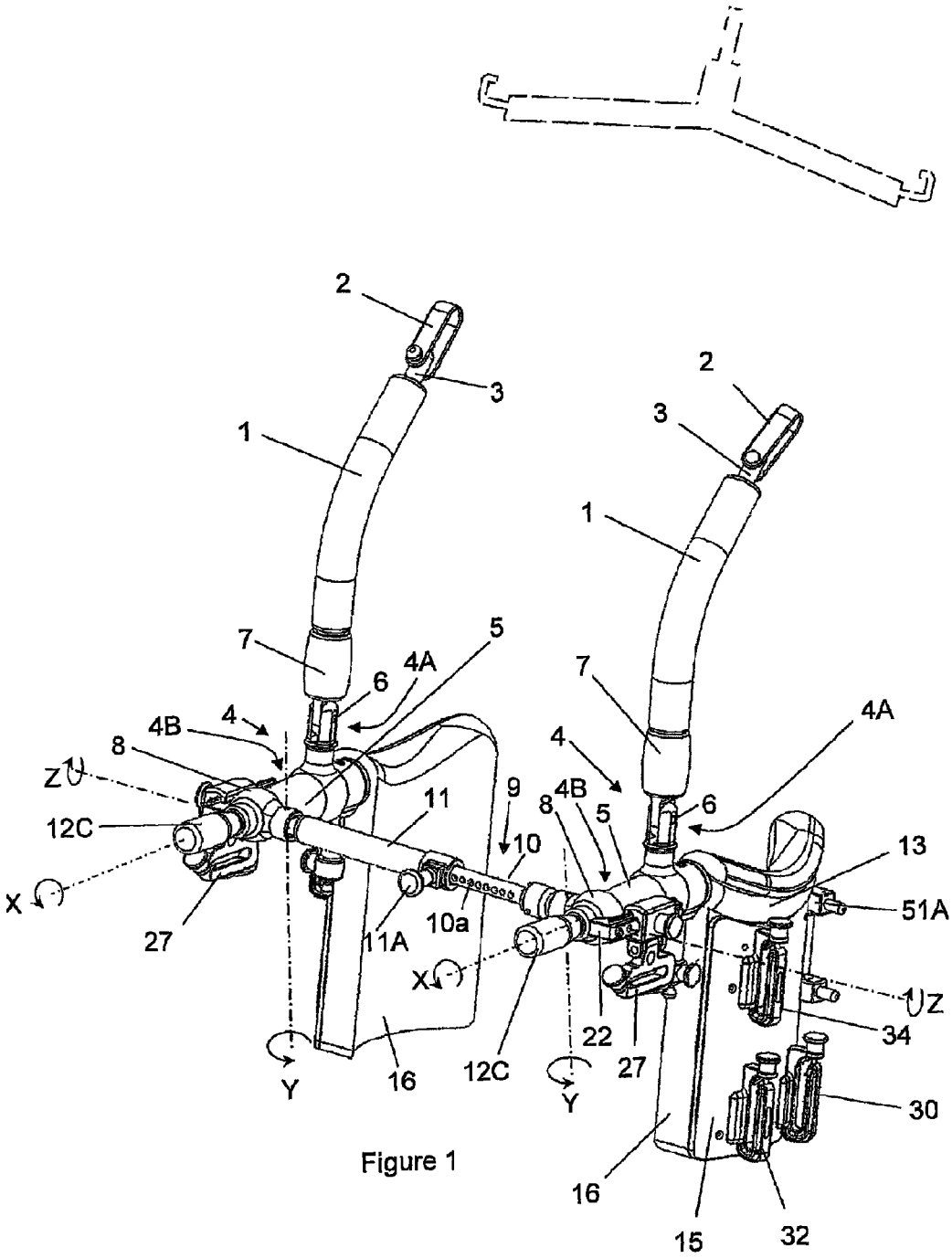
FIG. 1 is a perspective view of a patient lifting frame according to the invention without the head/neck support system or the patient lower body support means displayed.
Figure 5A:
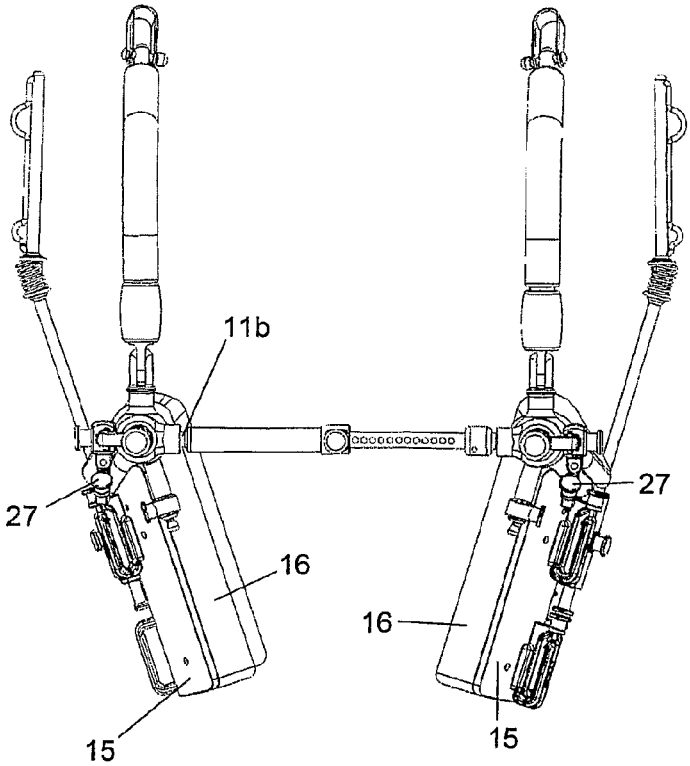
FIG. 5A is a front view of the first embodiment (of FIG. 3A) illustrating how the side pads 16 are rotatable relative to the boss element 5.
Figure 5B:
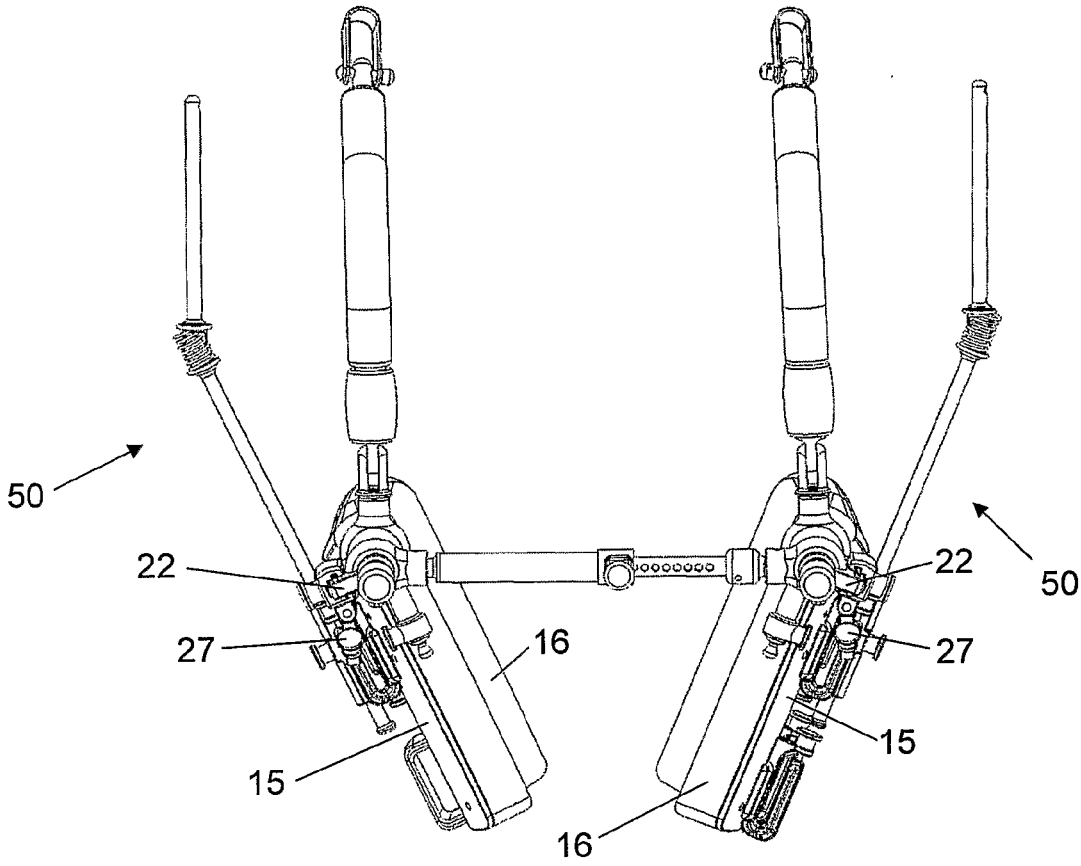
Figure 6A:
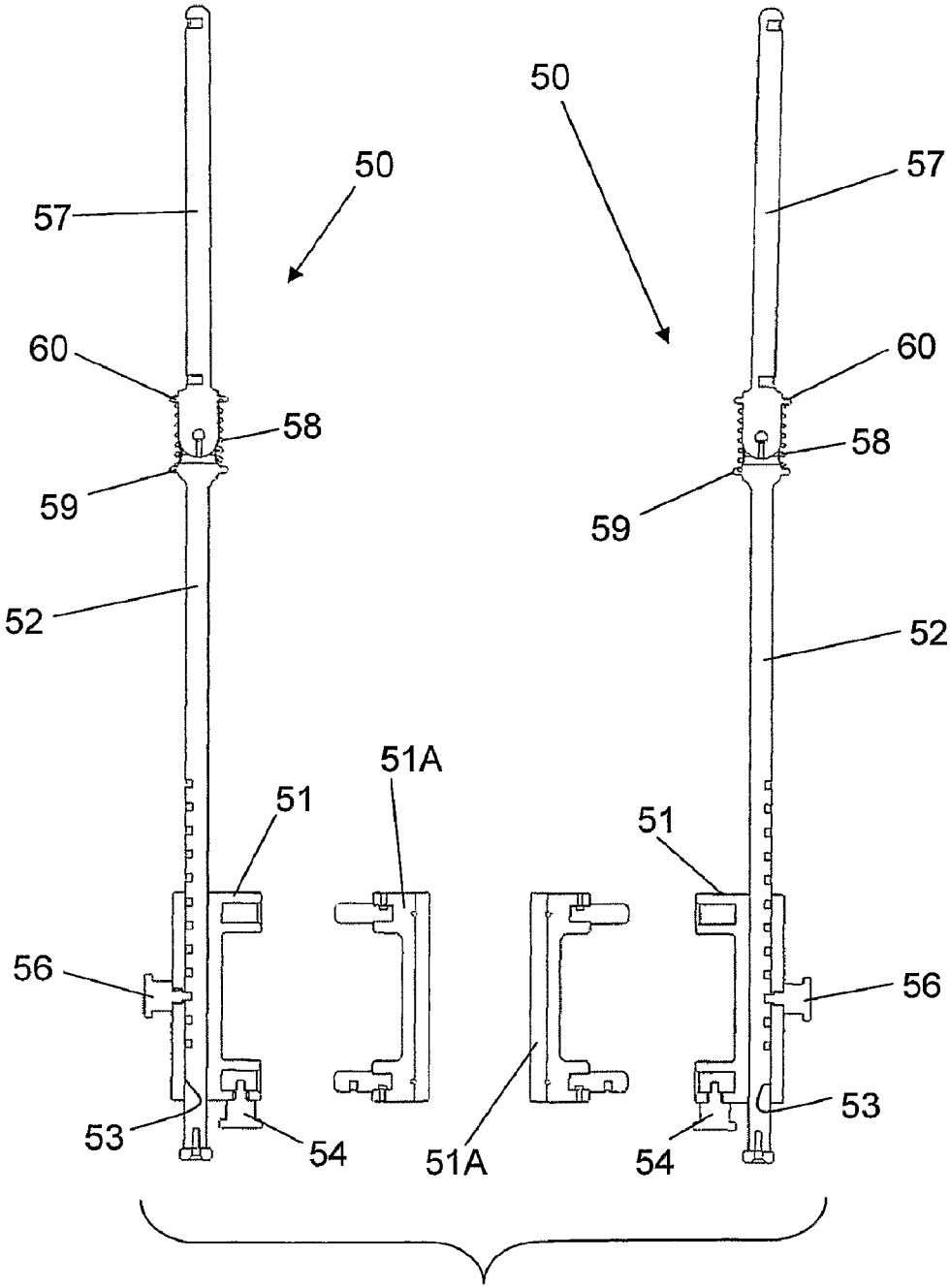
Figure 6B:
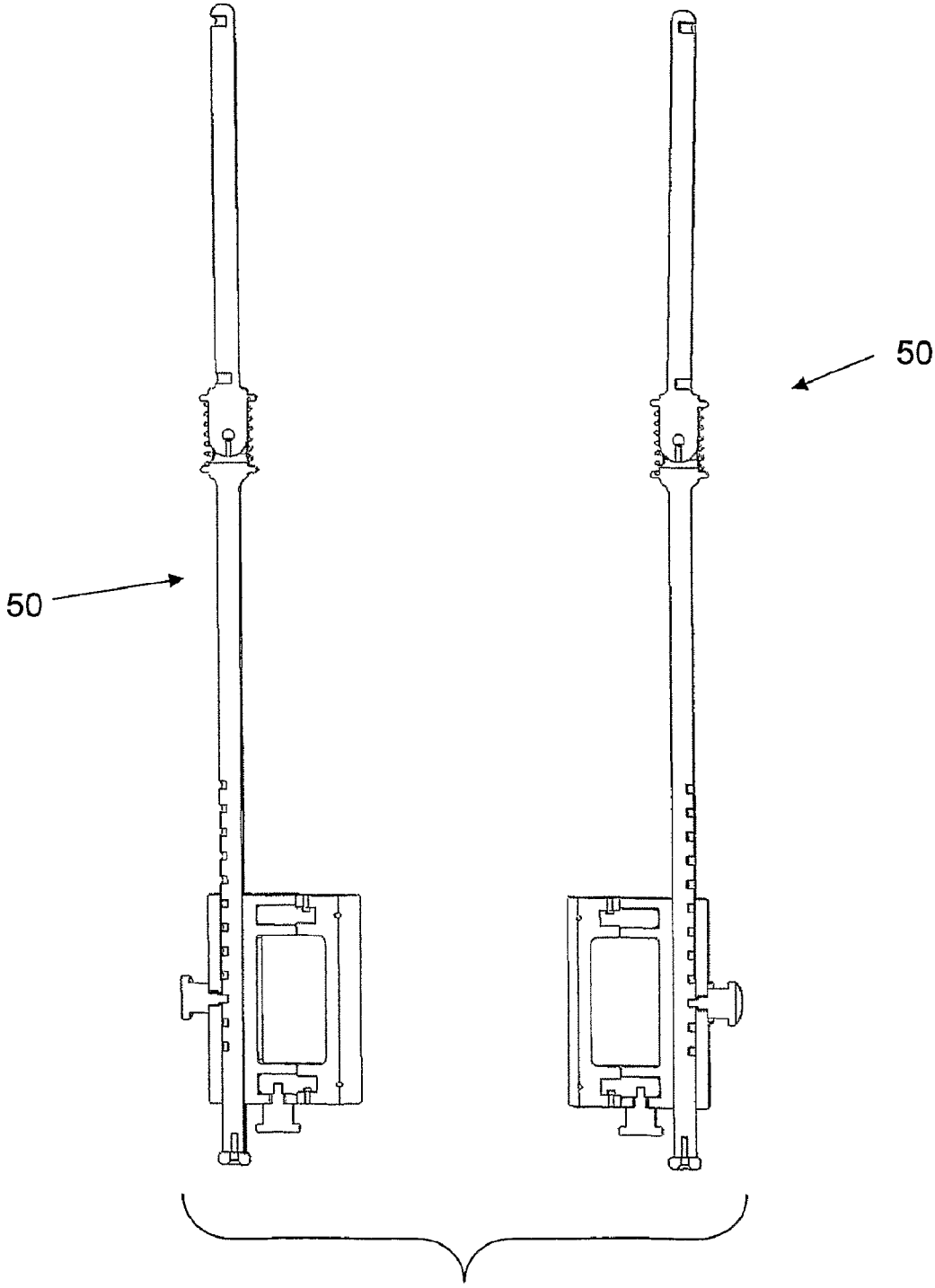
Figure 6C:
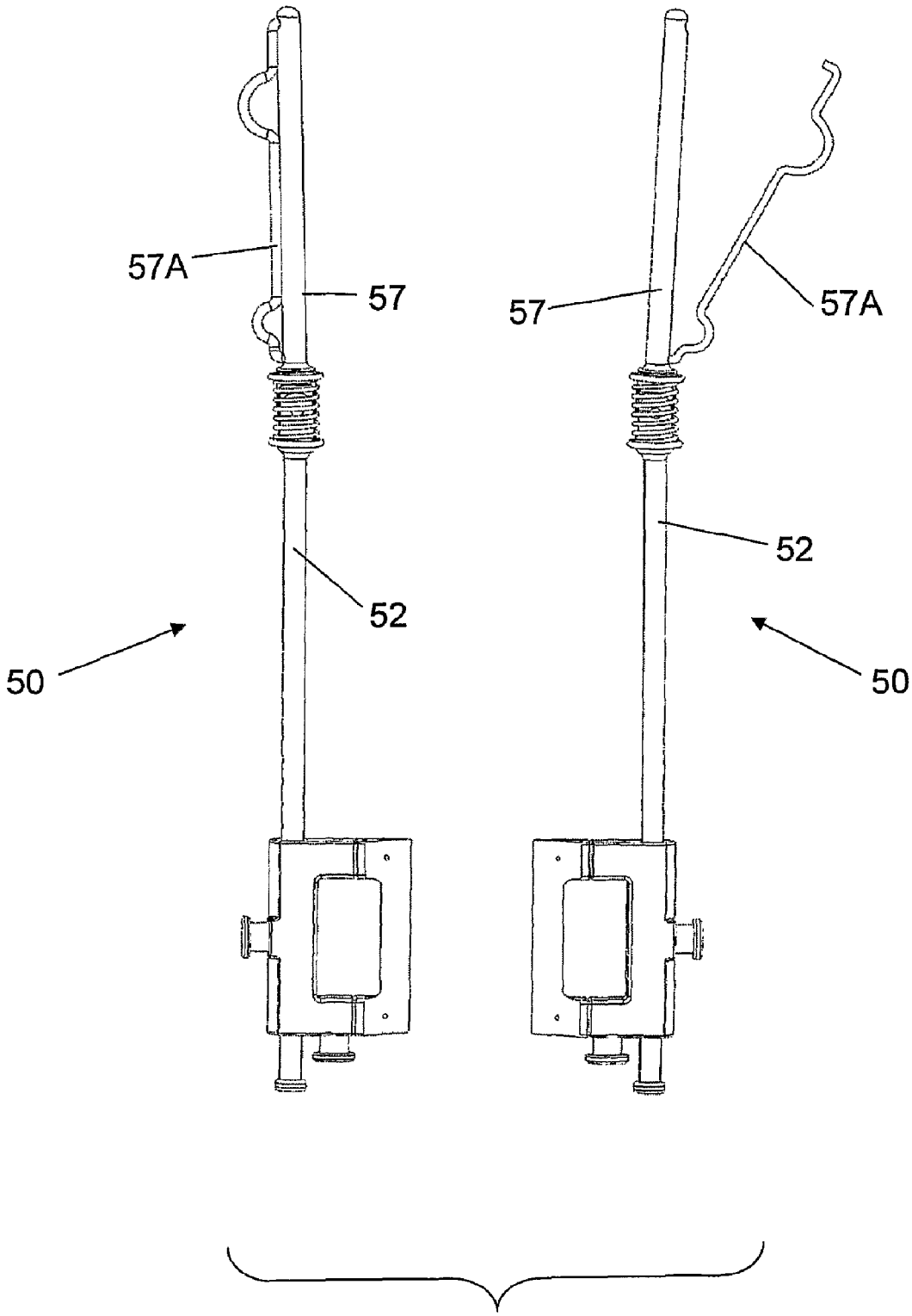
Figure 7:
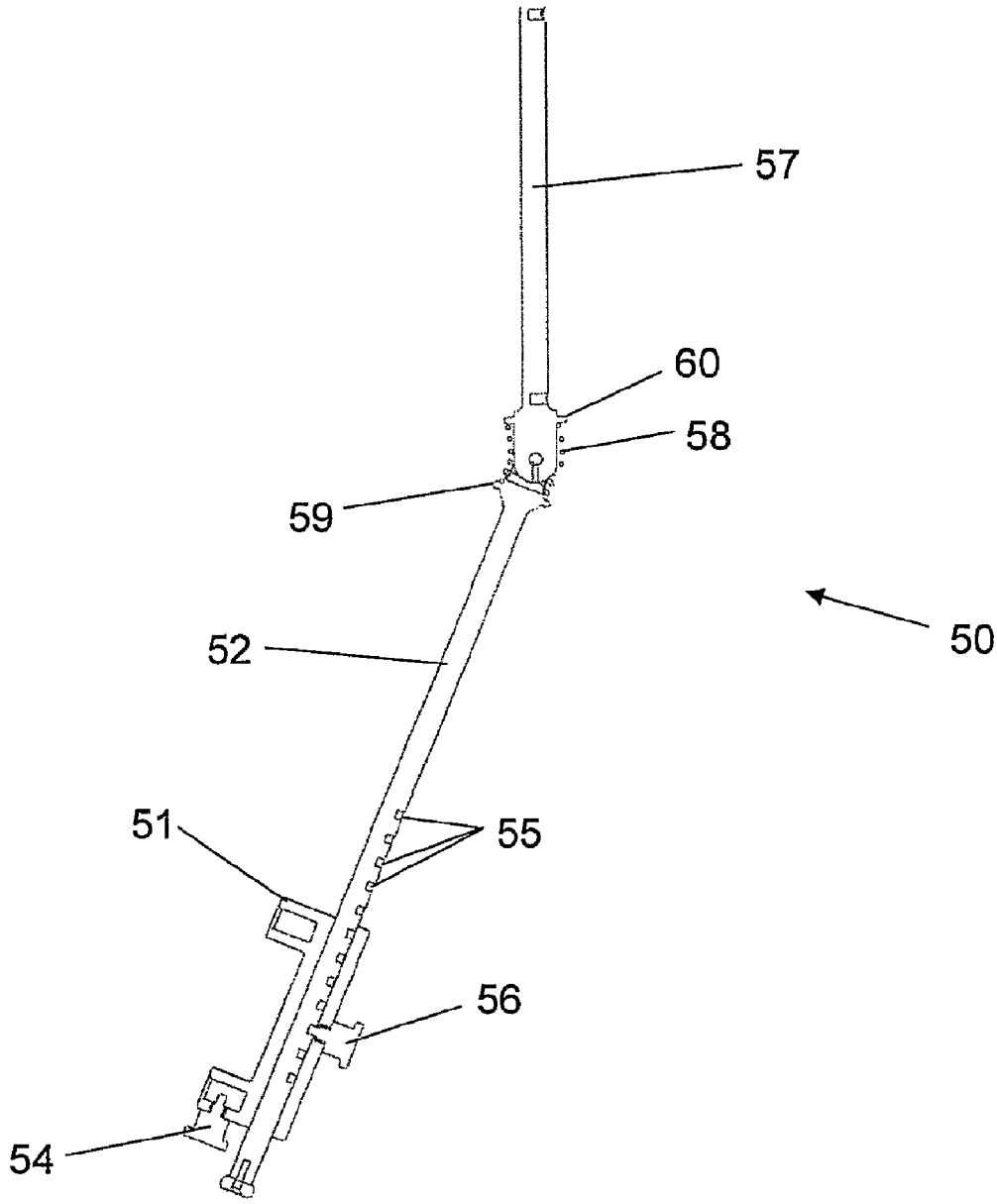
Figure 8:
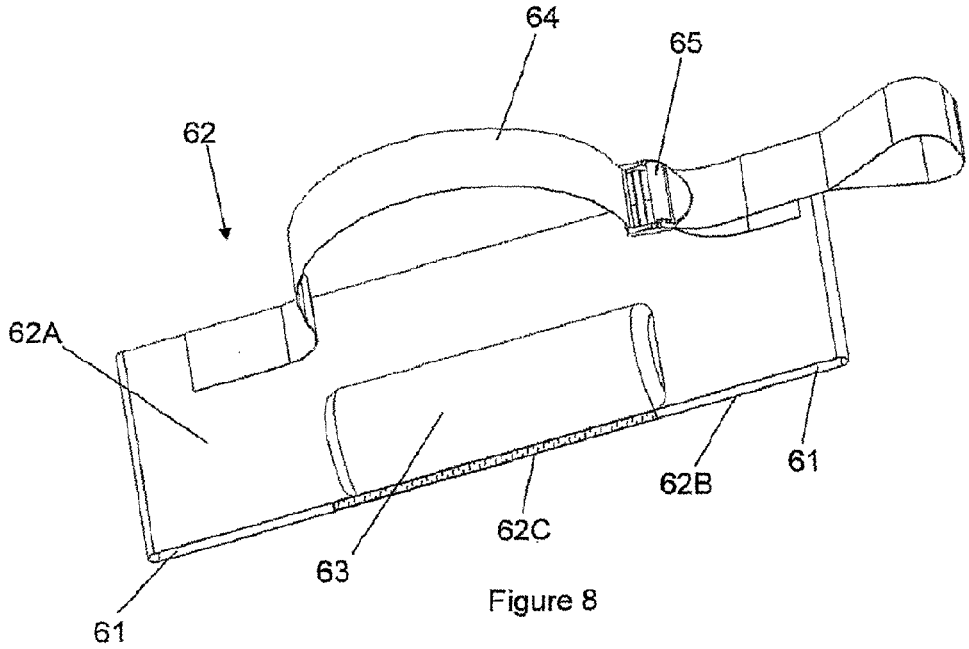
Figure 9:
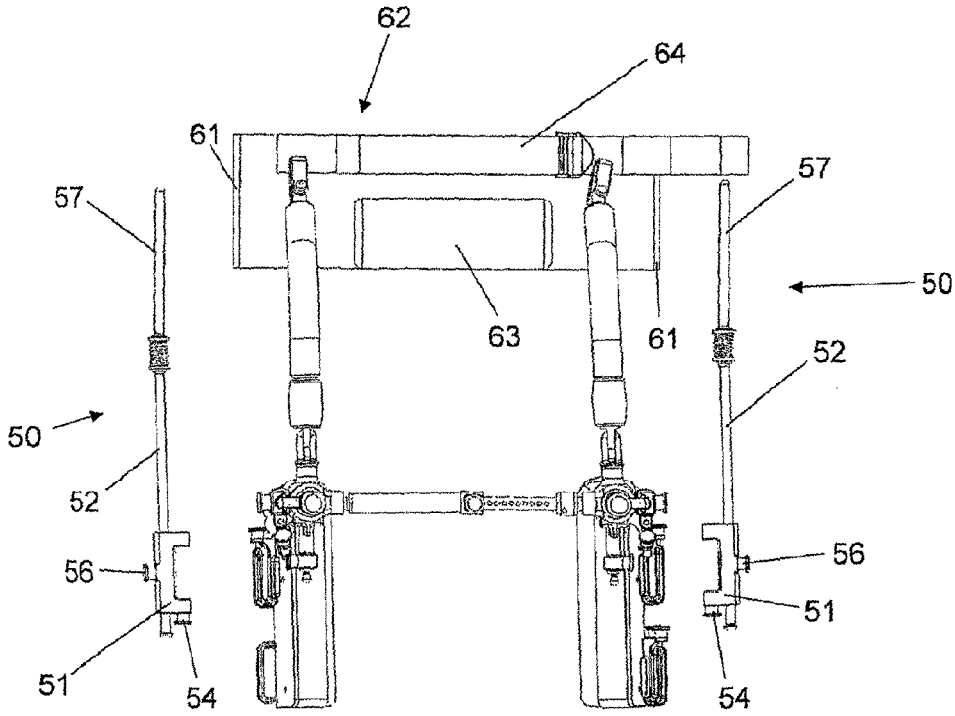
Figure 10:
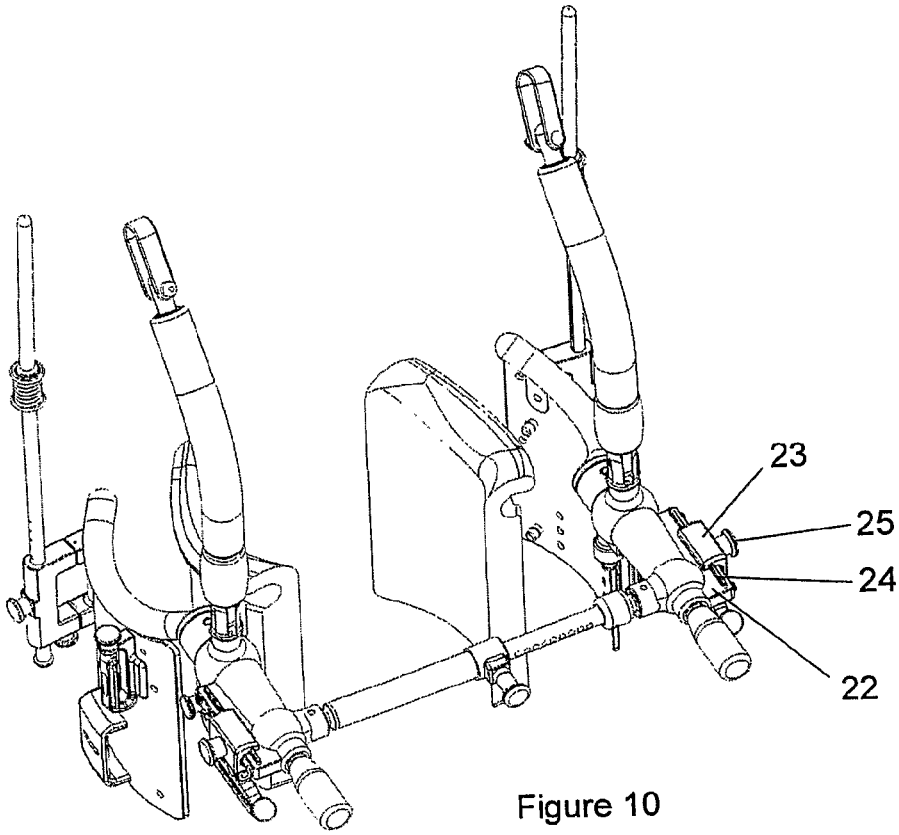
Figure 10A:
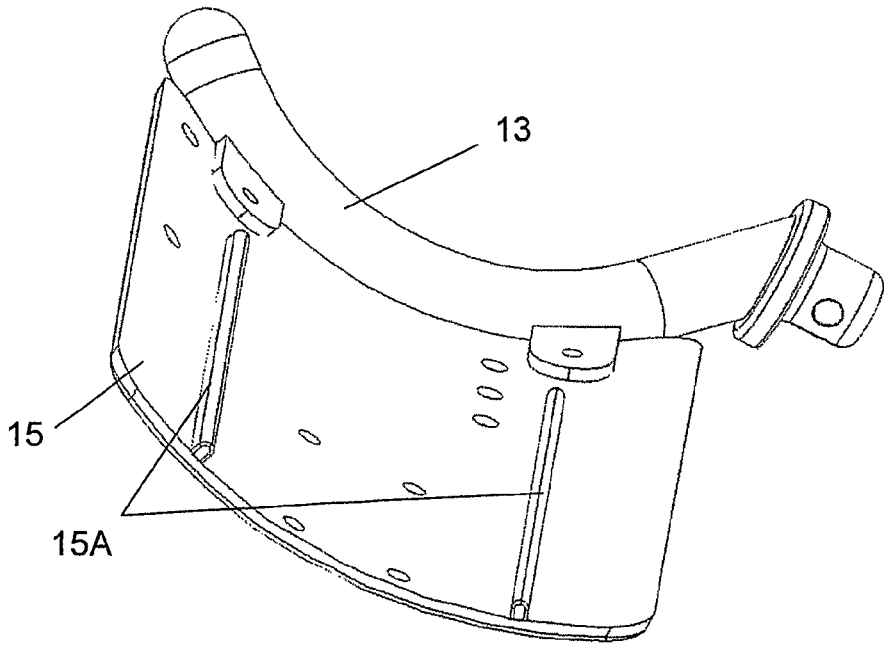
Figure 10B:
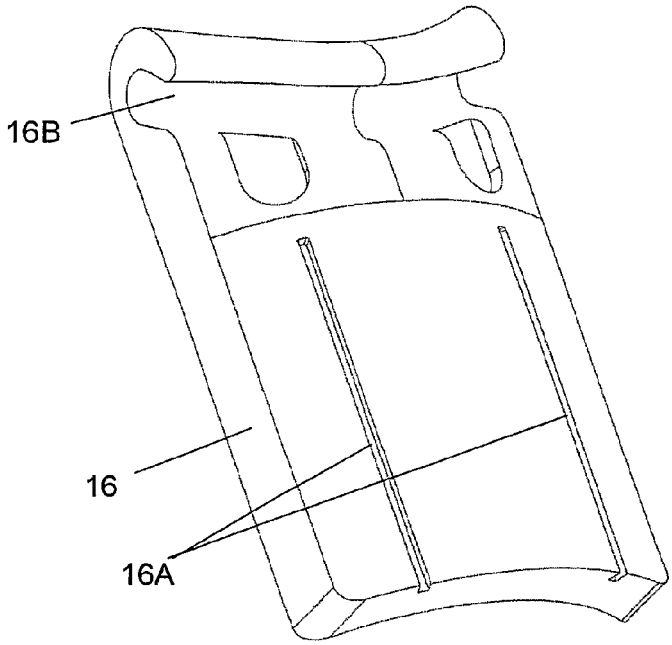
Figure 11:
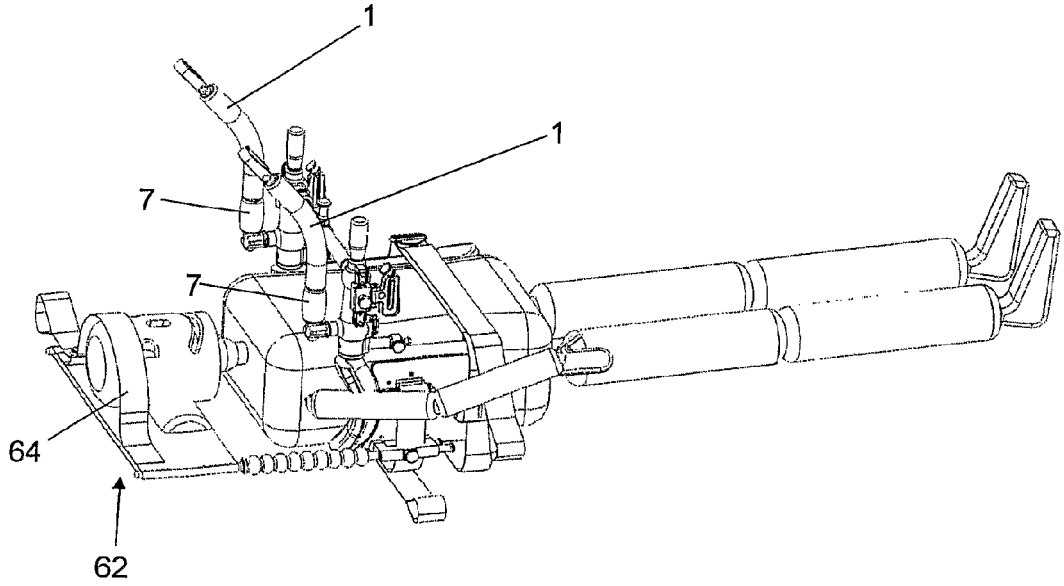
Figure 12:
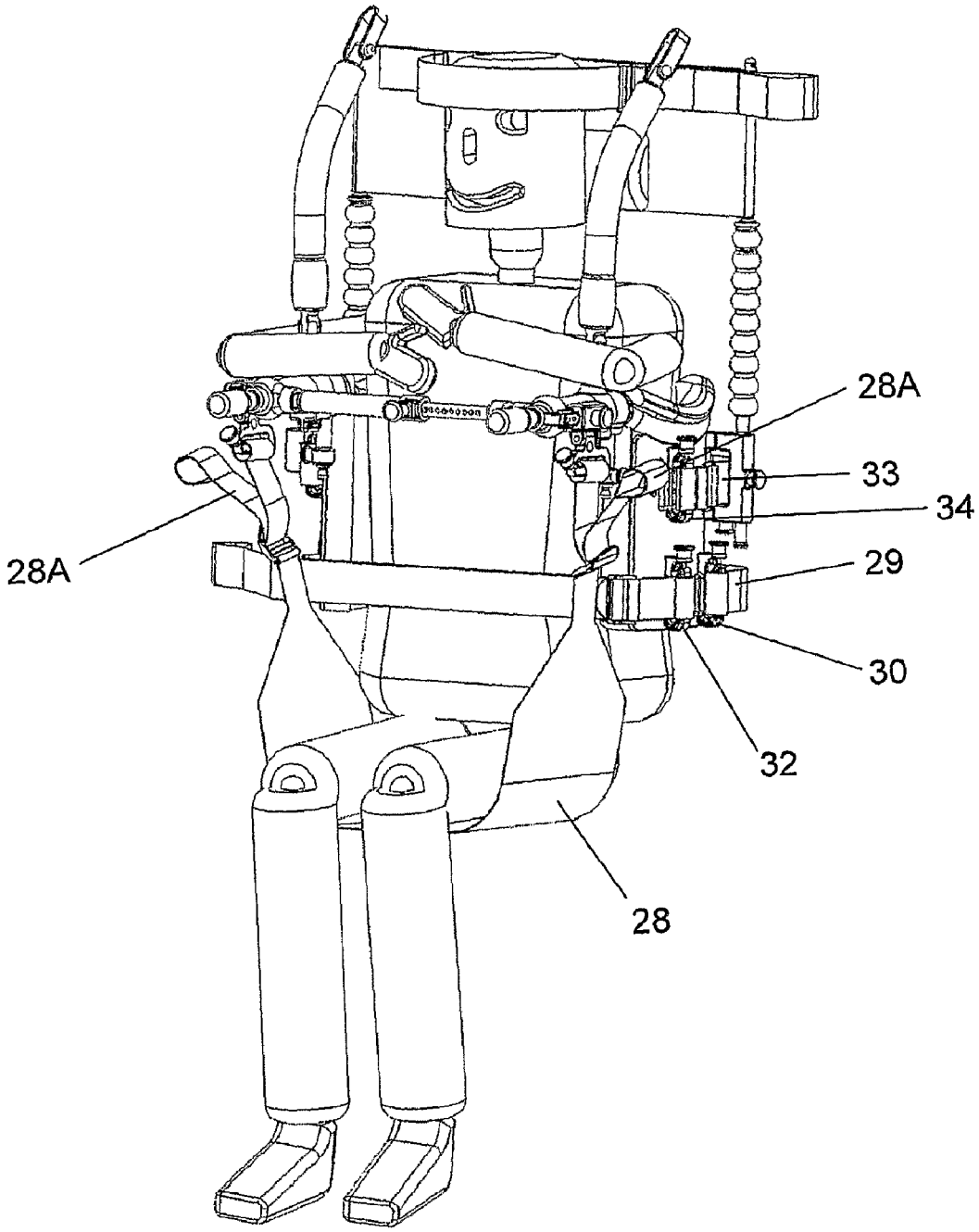
Figure 13:
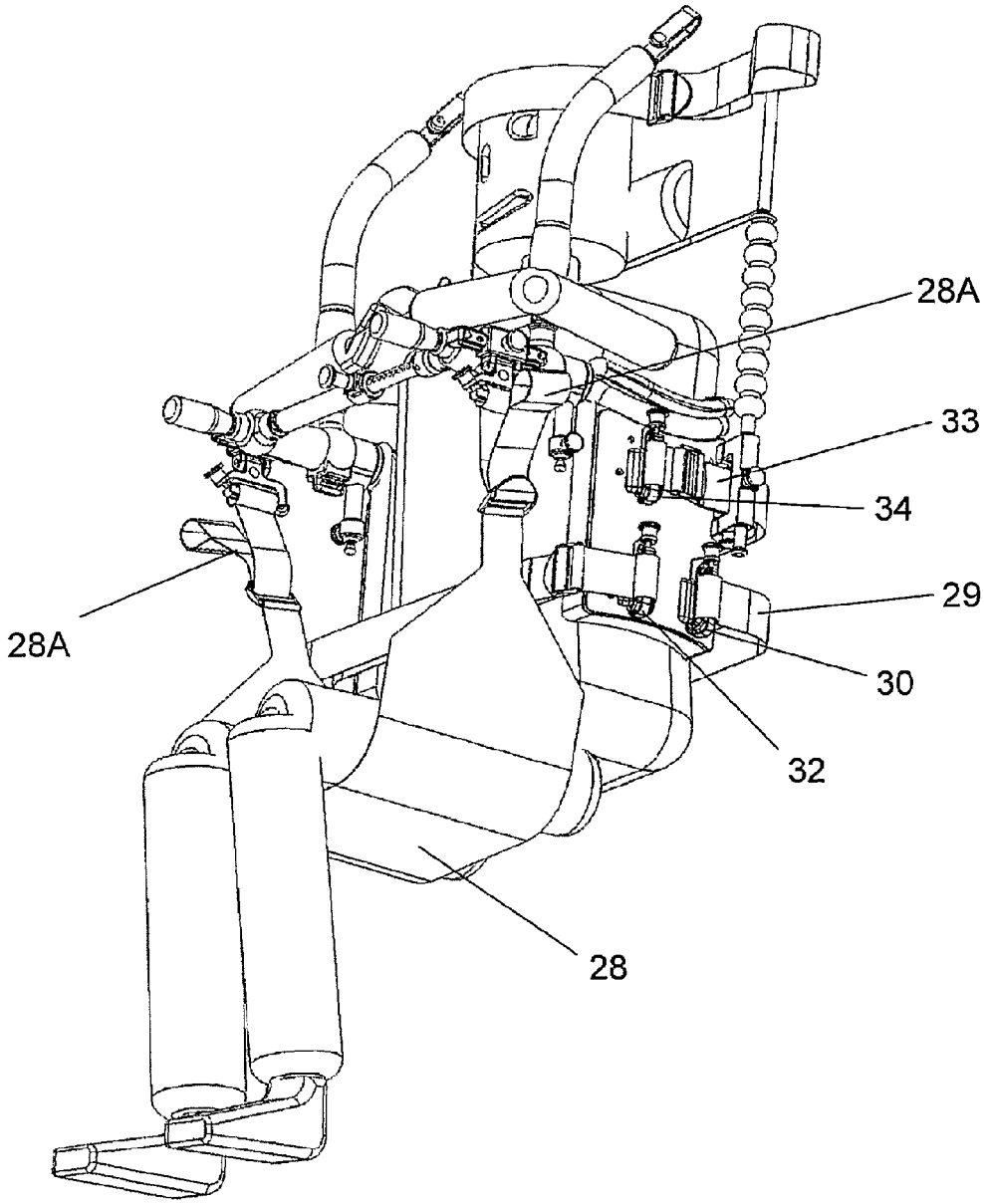
Figure 14:
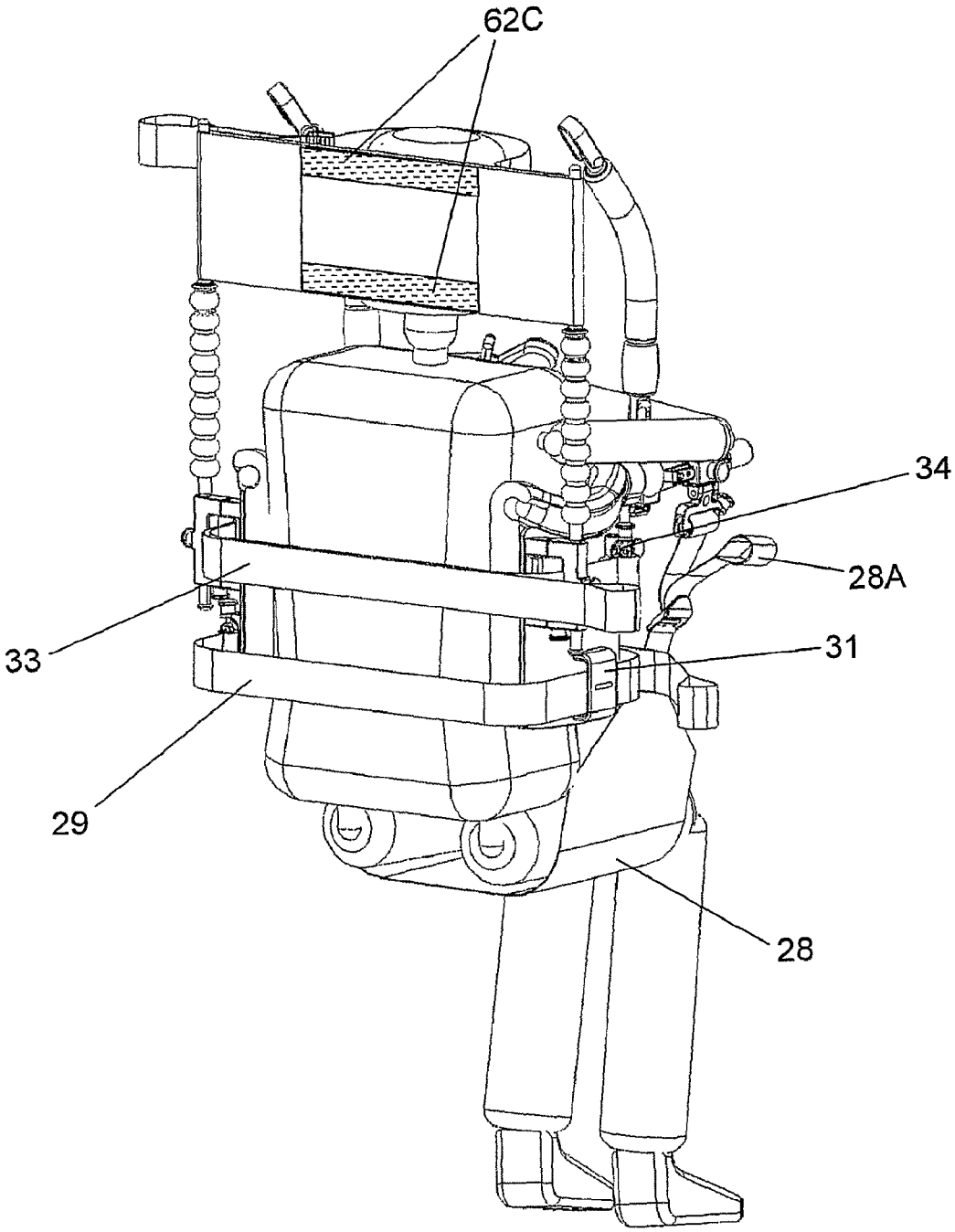
Figure 15:
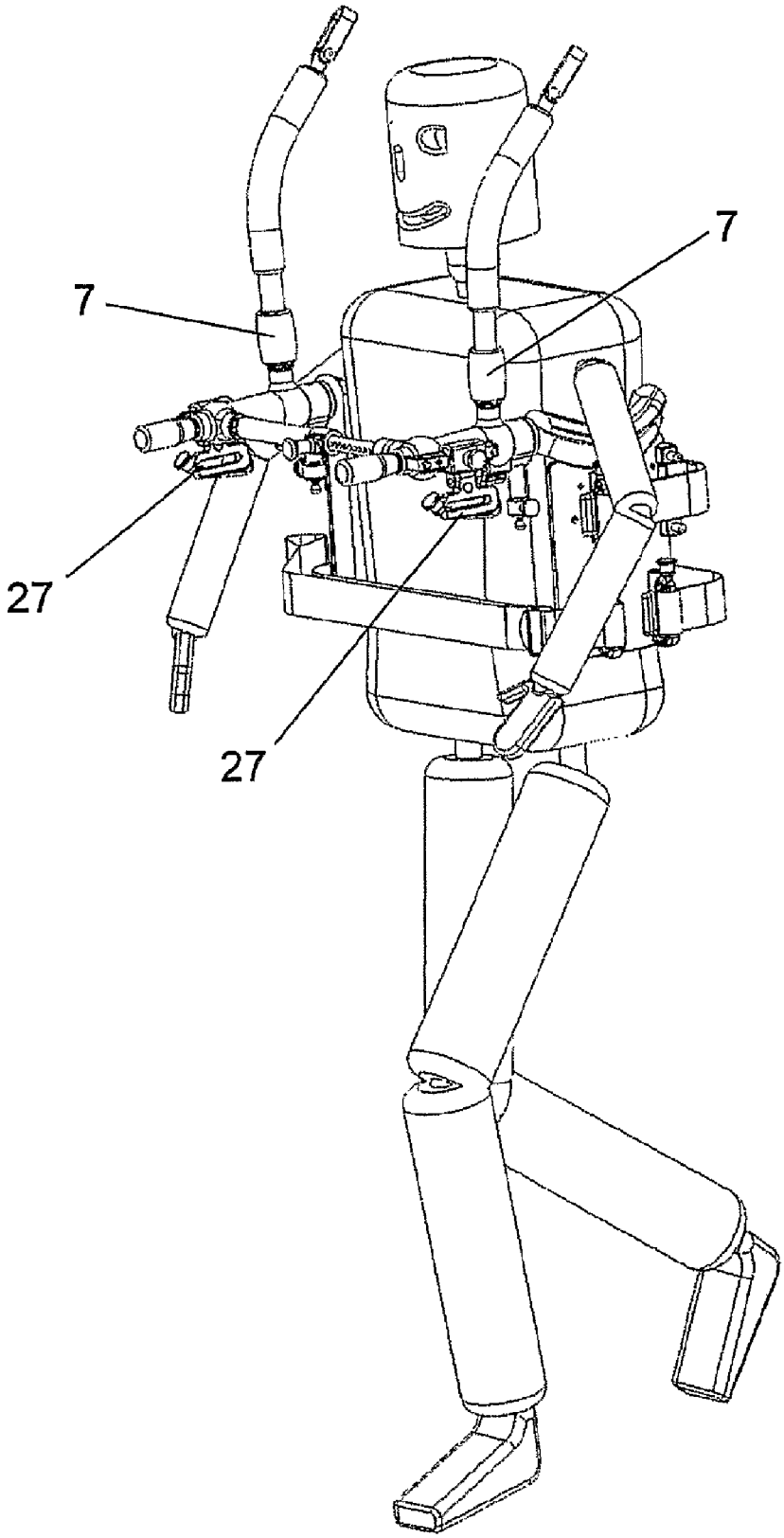
Figure 15A:
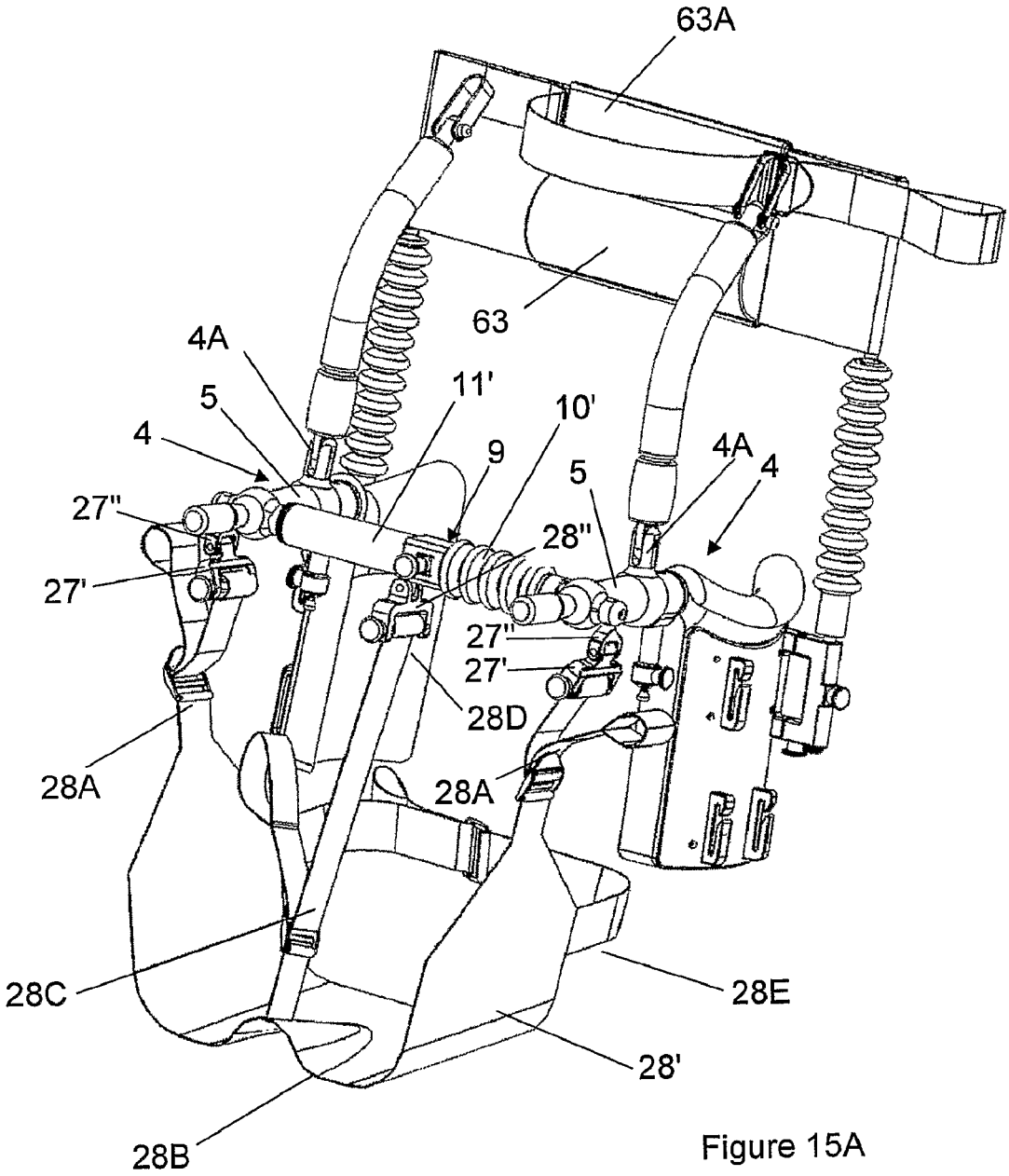
Figure 15B:
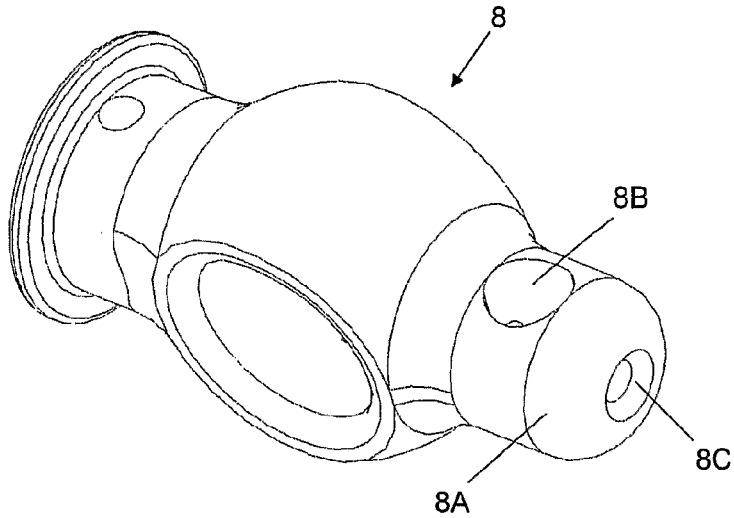
Figure 15C:
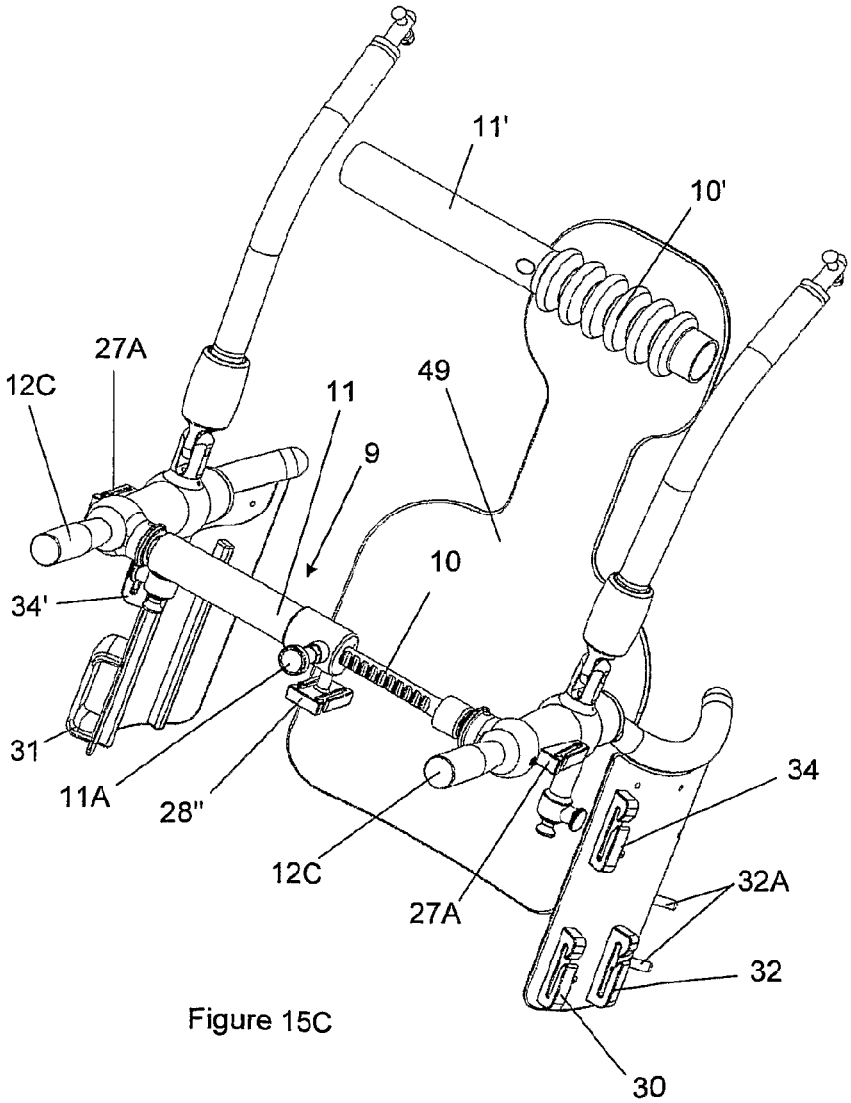
Figure 16:
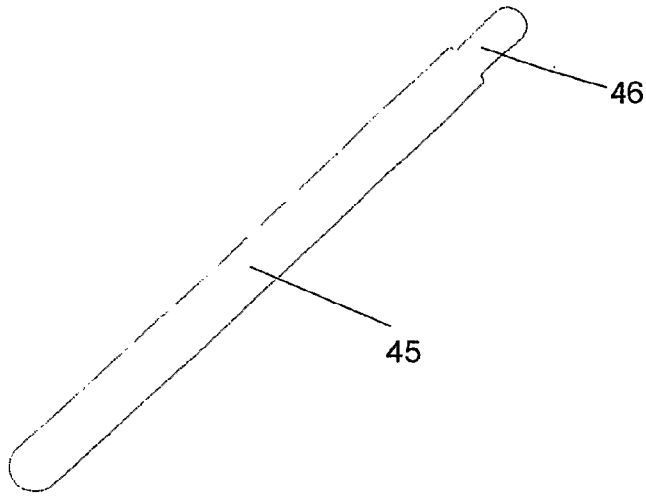
Figure 17:
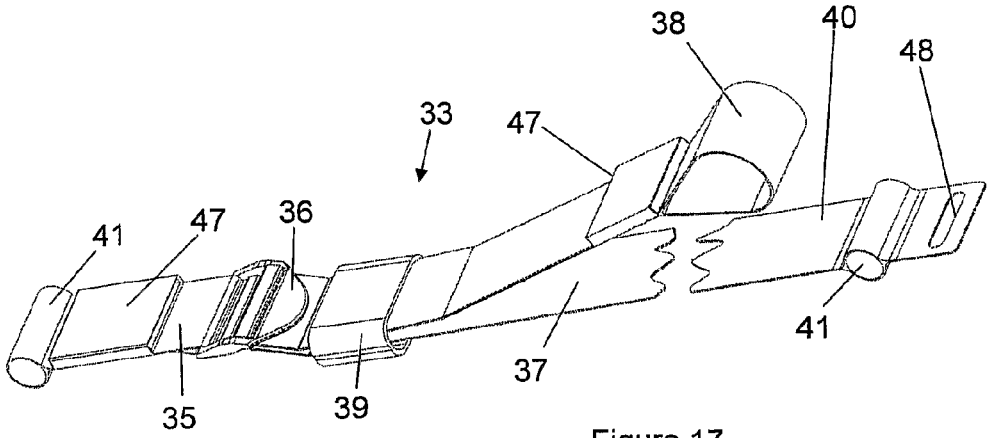
Figure 18:
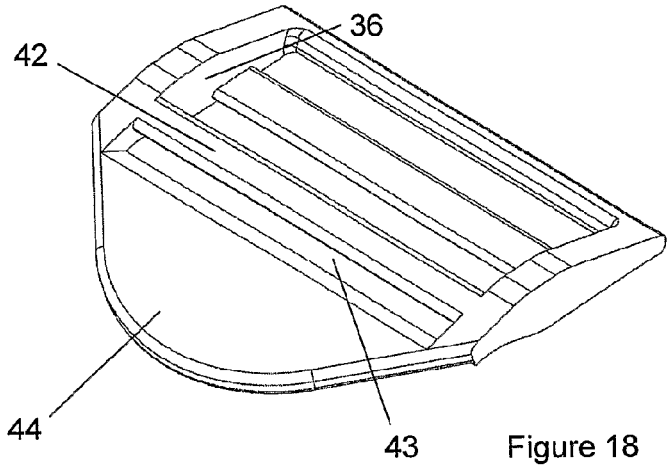
Figure 19:
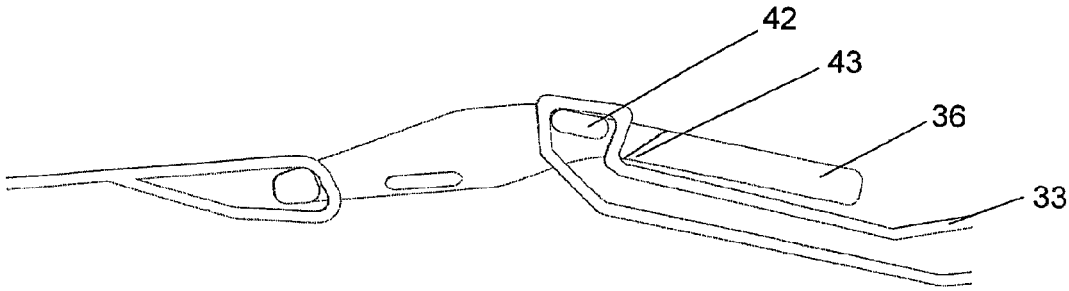
Figure 20:
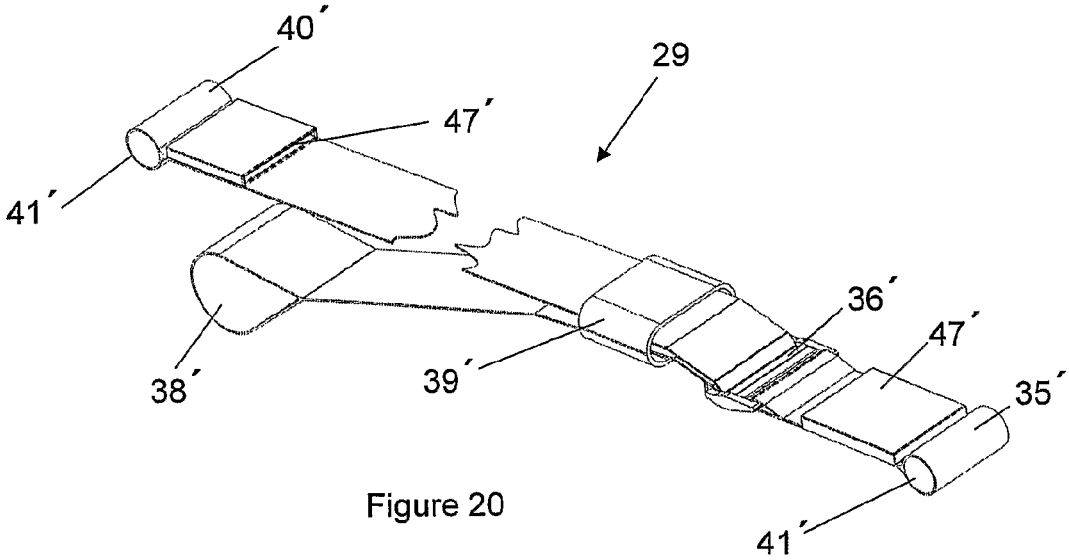
Figure 20A:
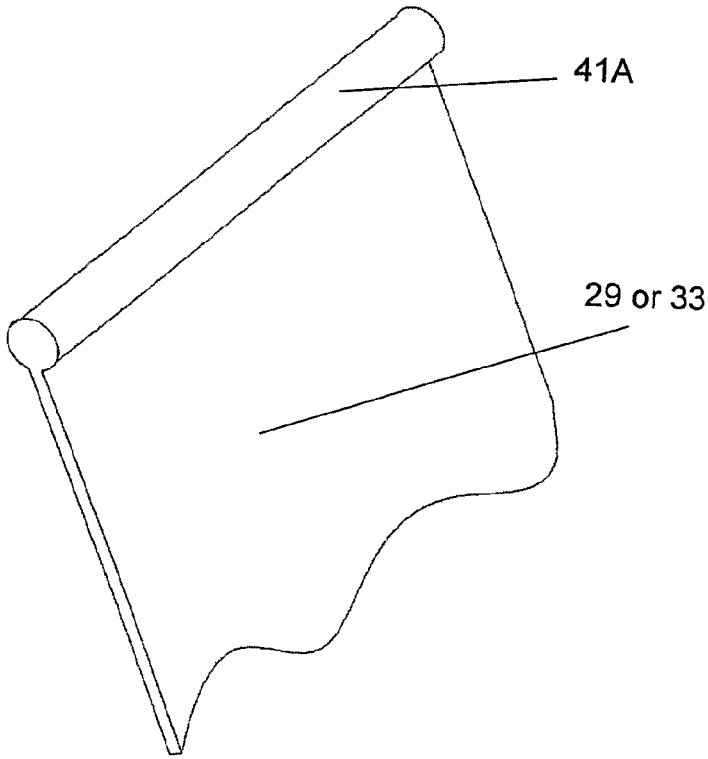
Figure 21:
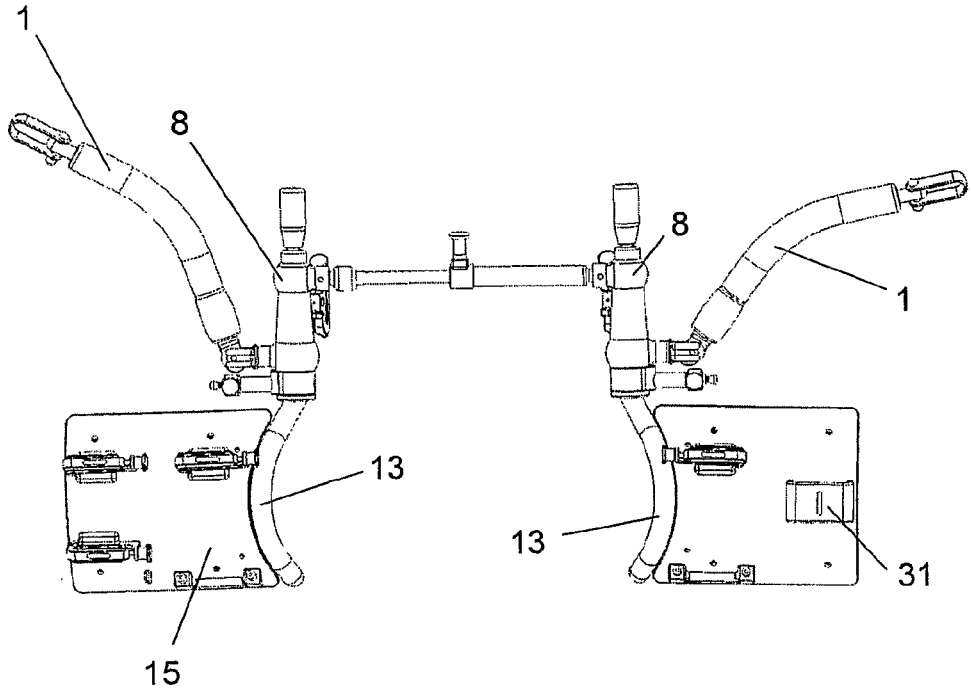
Figure 22:
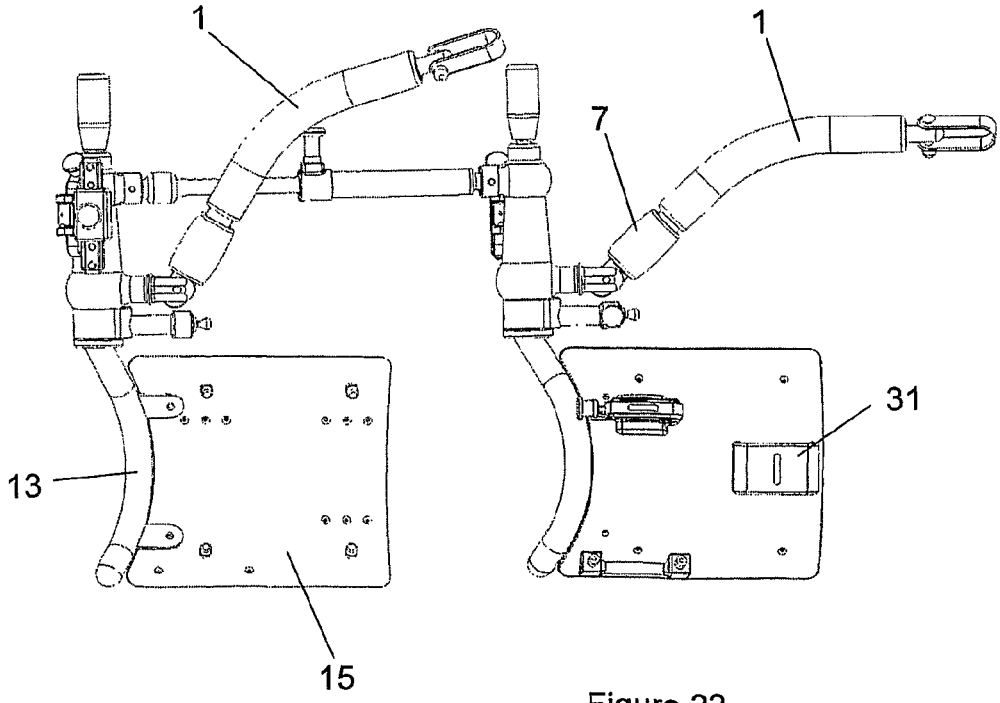
Figure 23:
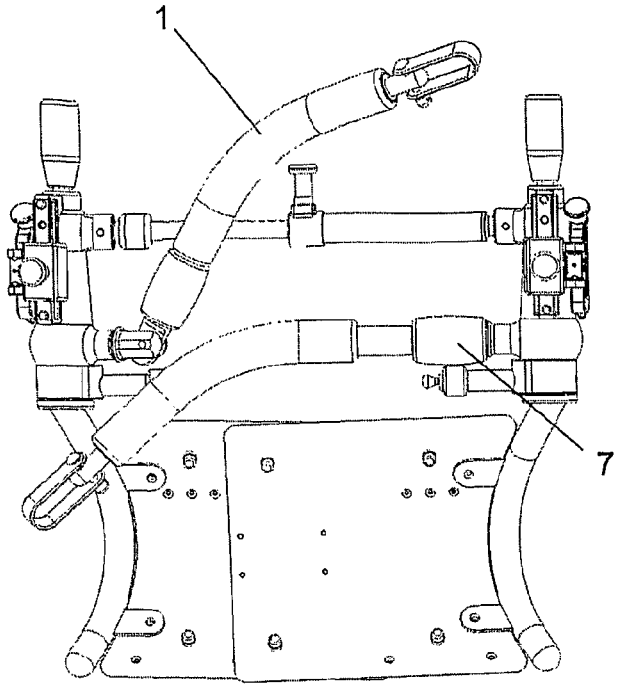
Figure 24:
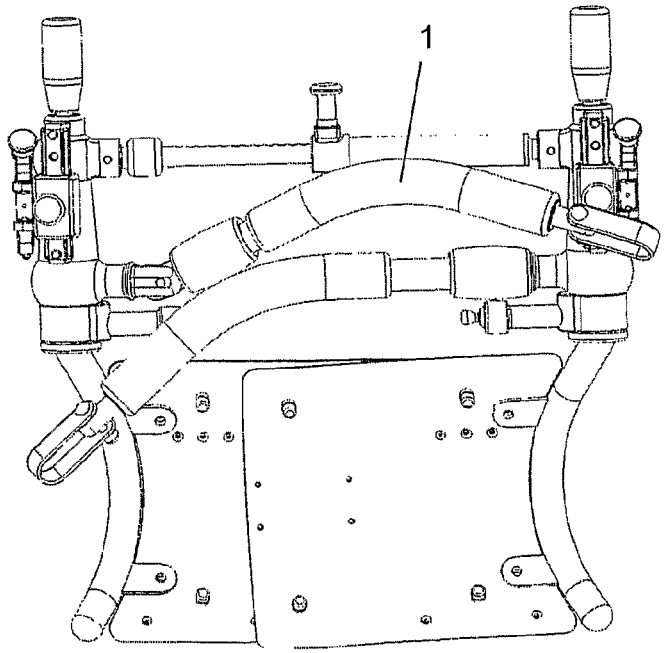
Figure 25:
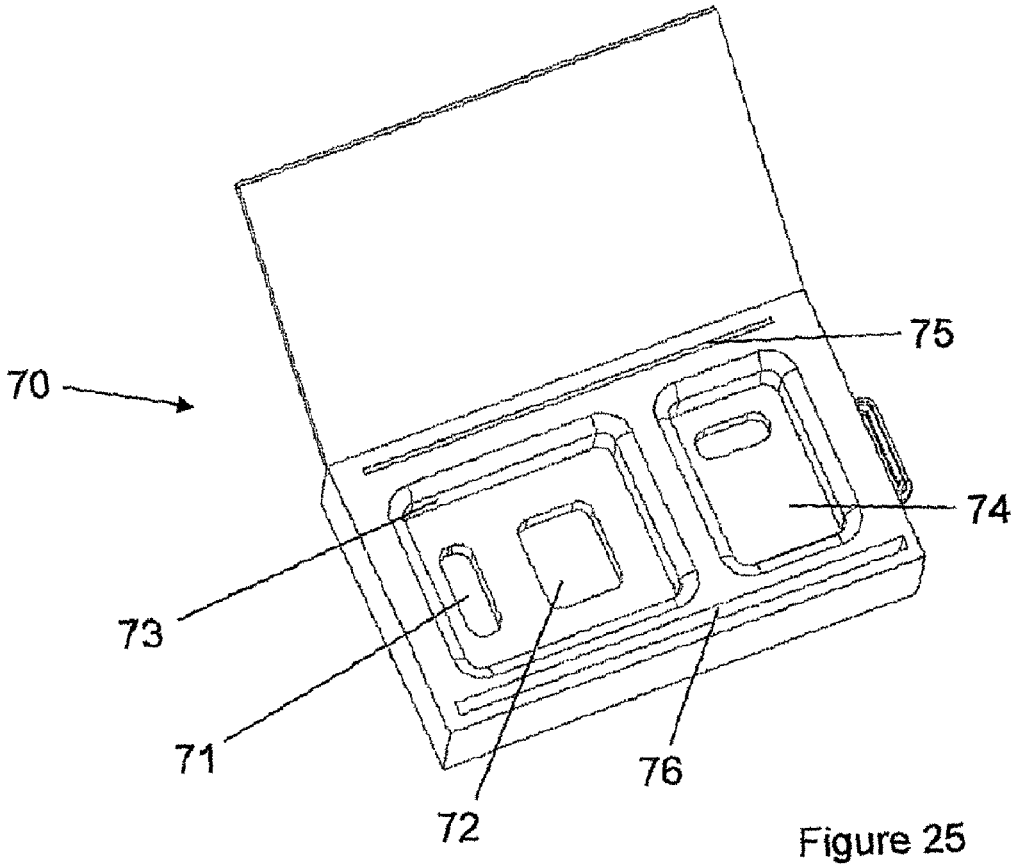
Figure 26:
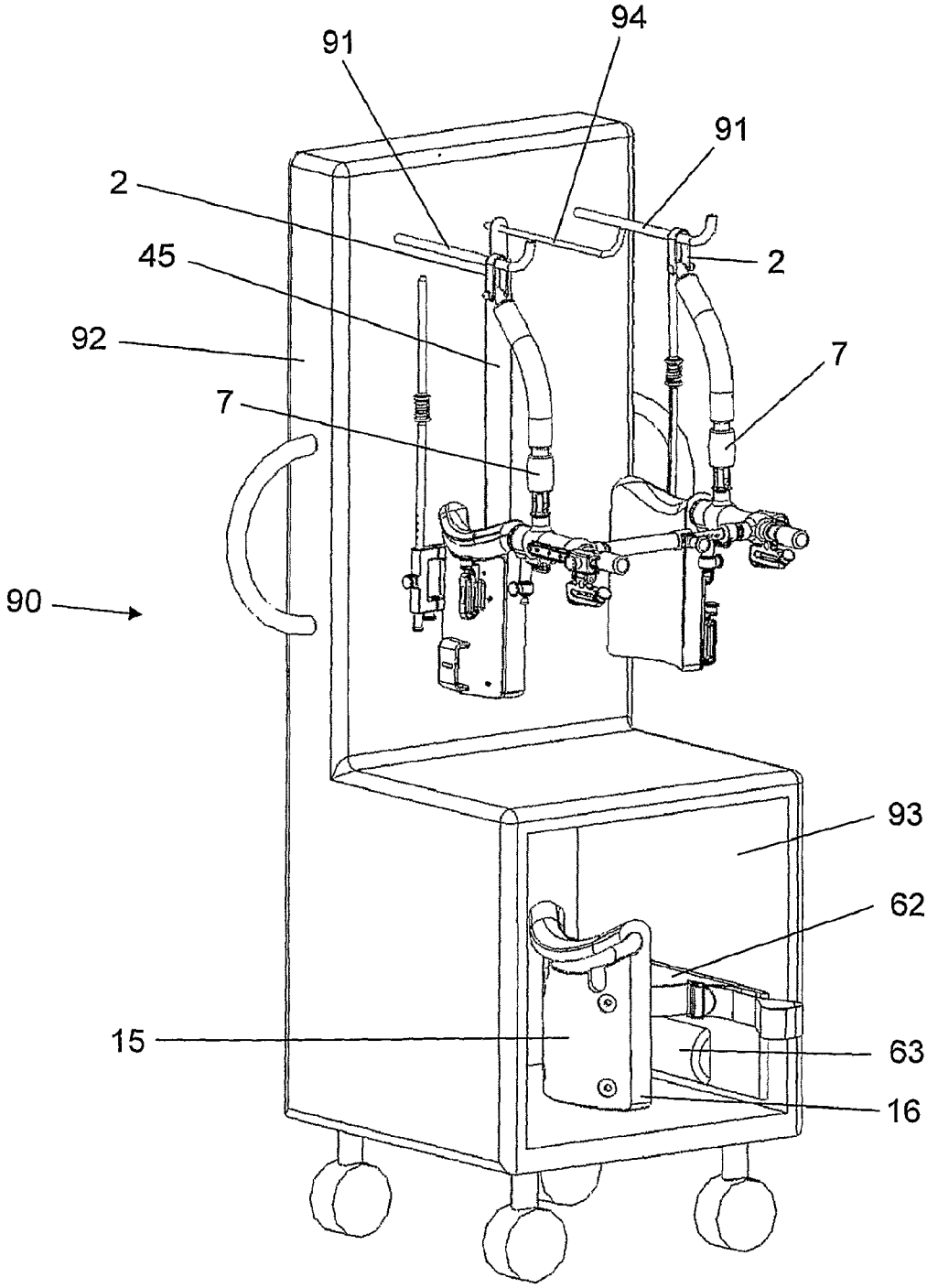

FIG. 5B is a front view of the second embodiment (of FIG. 3B) illustrating how the side pads 16 are fixed relative to the boss element 5 and pivot inwardly against the patient's ribcage in response to the downward force of the patient's lower body weight on the seat sling carriers 27;

FIG. 6A is an axial section through a pair of resilient upstanding posts of a patient head and neck support and their attachment means to the side plates;

FIG. 6B is a section similar to that of FIG. 6A but with the posts connected to the attachment means;

FIG. 6C is a non-sectional front view of FIG. 6B;

FIG. 7 is an axial section through one of the posts of FIGS. 6A-C;

FIG. 8 is a perspective view of a head cushion support for a patient's head which is a further component of the patient head and neck support;

FIG. 9 is an exploded front view of the lifting frame of FIG. 1, the posts of FIGS. 6 and 7 and the cushion support of FIG. 8;

FIG. 10 is a perspective view similar to that of FIG. 1 but at a higher angle, illustrating the connection of the head and neck support posts to the side pad plates and the detachable nature of the side pads relative to the side pad plates;

FIG. 10A is a perspective view from below of a modified side plate to be used in either of the illustrated embodiments;

FIG. 10B is a perspective view of a side pad to be used with the side plate of FIG. 10A;

FIGS. 11 to 15 are schematic illustrations of the interengagement between the lifting frame of FIG. 1 and a patient, illustrated schematically as a humanoid form, of which:

FIG. 11 illustrates the patient in a prone position lying face-up with the head/neck support system attached;

FIGS. 12 to 14 illustrate the patient lifted to a sitting position, viewed from various angles; and FIG. 15 illustrates the patient lifted to a standing or walking position, as if in physiotherapy, with the kinematic locks of the lifting frame engaged; and the head/neck support system detached;

FIG. 15A illustrates the lifting position of FIG. 12, but for clarity without the patient being included in the Figure and showing a third embodiment of the invention, being a modification of the lifting frame of either the first or the second embodiment as shown in the previous drawings, incorporating a modified seat sling 28';

FIG. 15B is a perspective view of one of the universal joints 8 of FIG. 15A;

FIG. 15C illustrates a modification of the lifting frame of FIG. 15A. The seat sling of FIG. 15A has been removed for reasons of clarity;

FIG. 16 is a perspective view of the elongated pusher element for passing the straps beneath the back of a patient lying face up in the prone position or behind the back of a patient sitting and leaning backwards against a chair back or a wall;

FIG. 17 is a perspective view of the top one of a pair of straps for drawing the side pads against the sides of the patient in use;

FIG. 18 is a perspective view of the release buckle of the strap of FIG. 17;

FIG. 19 is a side sectional view through the release buckle and straps of FIGS. 17 and 20;

FIG. 20 is a perspective view of the other of the straps for drawing the side pads against the sides of the patient in use, being the lower of the two straps and intended to pass completely around the patient and around both side plates & side pads;

FIG. 20A is a perspective view of a modified strap end;

FIG. 21 is a plan view of the suspension side bars and patient upper body support frame of FIG. 1, spread out flat;

FIGS. 22, 23 and 24 show the progressive folding movements needed to collapse the patient lifting frame from the position of FIG. 21 to a flat folded storage position as shown in FIG. 24;

FIG. 25 is a perspective view of a storage case for storage and transportation of the patient lifting frame of FIG. 1; and FIG. 26 is a perspective view of a storage trolley for the patient lifting frame of FIG. 1, suitable for hospital use.

DETAILED DESCRIPTION OF THE INVENTION

The principal elements of the patient lifting frame of FIG. 1 are a pair of padded suspension side bars, a patient upper body support frame and a patient lower body support means (not shown). The padding for both suspension side bars will be made from silicon material or anything similar provided for patient safety and comfort. Most parts illustrated in FIG. 1 may be made of metal, which is preferably a strong light alloy in order to reduce the total weight as much as possible, or of an engineering grade plastic material such as a glass reinforced nylon which may be injection-mouldable. The parts shown in FIG. 1, if made of metal, may be solid or tubular, the latter providing strength without contributing excessive weight.

The suspension side bars each carry the reference numeral 1, and each is provided at its upper end with a suspension shackle 2 pivotally connected to a shackle connector 3. The shackle connector 3 is itself rotatable about its longitudinal axis, and in use the shackles 2 are hooked over opposite ends of a spreader bar carried by an invalid hoist. The spreader bar, not being a part of the invention, is shown in broken line only in FIG. 1.

Although the shackles 2 are illustrated in FIG. 1 as being U-shaped shackles made from bent plate, they may alternatively and preferably be made from flat wire braid, preferably coated with a smooth wear-resistant coating such as a fabric or plastic or rubber coating, because they will distribute the full load across larger areas on each spreader bar hook and help to prevent damage to the spreader bar while lifting patients. The braids themselves may be easily replaced when necessary.

The suspension side bars 1 may be tubular or solid, and at the lower end of each is provided a suspension mounting 4. Each suspension mounting 4 comprises a 2-axis pivotal/rotary connector 4A and a cantilever side bar assembly 4B rotatably connected thereto, as will be described in greater detail later. A pivot pin 6 connects together the lower end of each suspension side bar 1 and a bifurcated upper end portion of its associated two-axis pivotal/rotary connector 4A, providing a pivotal connection therebetween along a first axis of the two-axis pivotal/rotary connector 4A. A sleeve 7 of a kinematic lock is provided around the lower end portion of each suspension side bar 1 immediately above the suspension mounting 4, and can be moved downwardly to lock the pivotal connection between the suspension side bar 1 and the 2-axis pivotal/rotary connector 4A of its associated suspension mounting 4 in a manner to be described later.

The only portion of the cantilever side bar assembly 4B visible in FIG. 1 is a boss 5 which extends forwardly in cantilever from the pivotal/rotary connector 4A and terminates at its distal end in a universal joint 8, the universal joints 8 connecting the distal ends of the bosses 5 together through a link bar assembly 9. The link bar assembly 9 comprises a rod 10 extending from a cylinder 11, so that the lateral distance between the two bosses 5 is variable by extension of the rod 10 from the cylinder 11 or retraction of the rod 10 further into the cylinder 11. The extension of the rod relative to the cylinder is lockable in any desired position using a spring-loaded lock button 11A. Alternatively in a modification (not illustrated) the link bar assembly 9 could be a single solid or tubular bar with the two universal joints 8 laterally slidable along the bar and lockable at different spacings one from the other. The link bar assembly 9 is preferably shrouded in a flexible rubber protector (not illustrated in FIG. 1 but added as 10', 11' for illustrative purposes in FIG. 15A). That protector may comprise a corrugated and extensible portion 10' which surrounds and cushions the rod 10, and a uniform diameter portion 11' which surrounds and cushions the cylinder 11, as illustrated in FIG. 15C.

Figure 2:
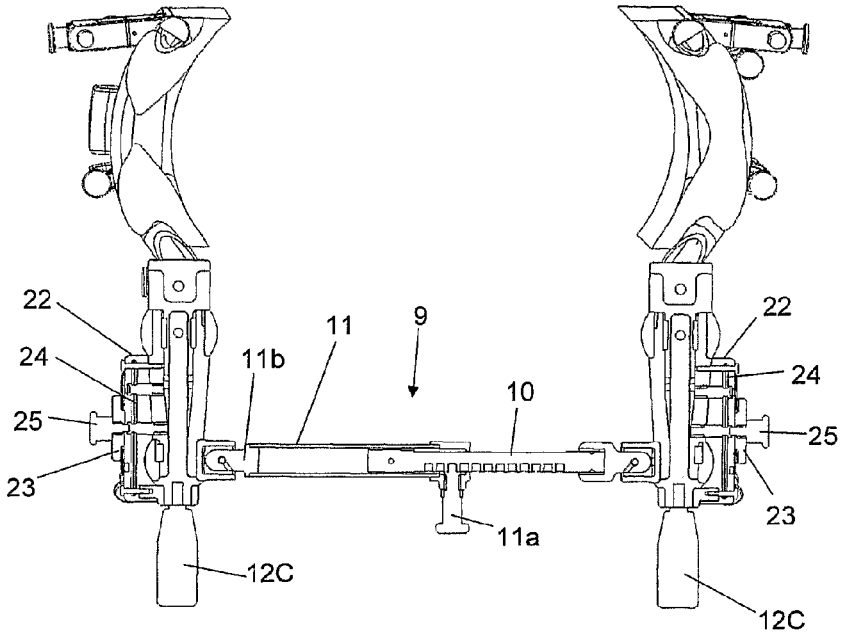
FIG. 2 is a horizontal section through the lifting frame taken along the axis of the link bar assembly 9 of FIG. 1.
Figure 3A:
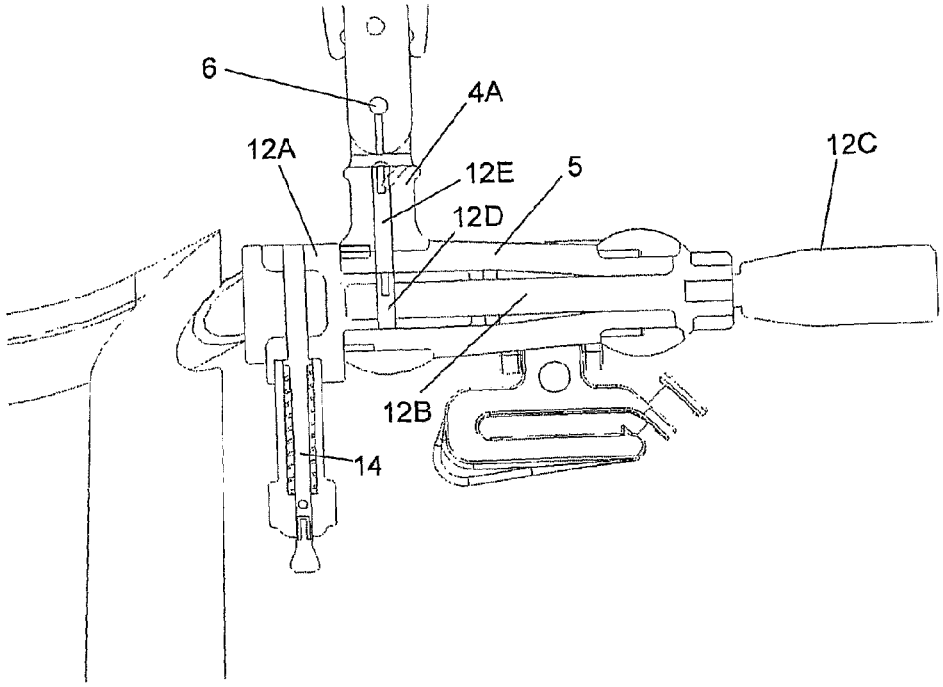
FIG. 3A is a vertical section through the suspension mounting of FIG. 2A according to a first embodiment of the invention.
Figure 3B:
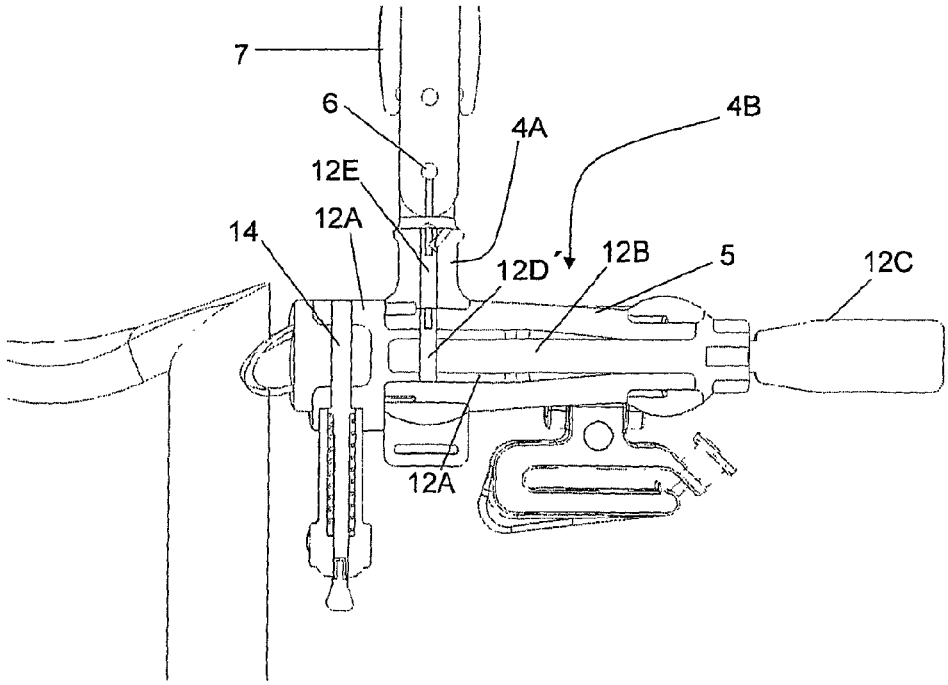
FIG. 3B is a vertical section through the suspension mounting of FIG. 2A according to a second embodiment of the invention.
Figure 4:
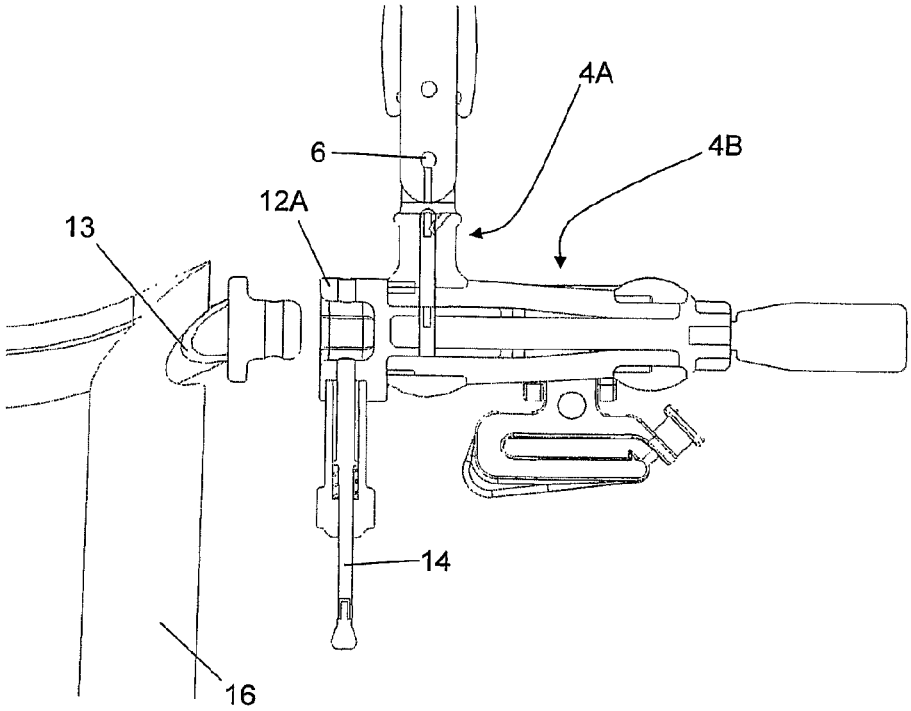
FIG. 4 is the same vertical section as FIG. 3A but with the patient upper body support means (13,15,16) removed.

The internal construction of the suspension mountings 4 is better illustrated in FIGS. 2 to 4. The cantilever side bar assembly 4B comprises the boss 5 which passes laterally through a cylindrical aperture in a support portion of the pivotal/rotary connector 4A, a patient upper body support connecting member 12A which plugs axially into a central bore in the boss 5, and a retaining shaft 12B which extends to the forward end of the boss 5 and retains the universal joint 8 in position.

A handle 12C is provided at the distal end of each retaining shaft 12B, the use of which will be described later.

In a first embodiment of the invention as illustrated in FIG. 3A, the boss 5 is rotatably immovable relative to the pivotal/rotary connector 4A but the connecting member 12A is rotatable relative to the boss 5. The axis of rotation defines the second axis of the 2-axis pivotal/rotary connector 4A, and is perpendicular to the axis defined by the pin 6 but offset therefrom. A pin 12D locks together the connecting member 12A and the retaining shaft 12B. A second pin 12E passing down a vertical bore centrally of the bifurcated upper portion of the pivotal/rotary connector 4A and locked in position there by a diagonally inserted grub-screw locks together the boss 5 and the pivotal/rotary connector 4A, keeps the pin 12D securely in place and prevents ingress of dirt. The pin 12E spans the vertical bore in the pivotal/rotary connector 4A and a radial bore in the boss 5, and therefore prevents rotation of the boss 5 relative to the pivotal/rotary connector 4A while permitting rotation of the connecting member 12A relative to the boss 5.

In a second embodiment of the invention as illustrated in FIG. 3B, the boss 5 is free to rotate relative to the pivotal/rotary connector 4A. The axis of rotation defines the second axis of the 2-axis pivotal/rotary connector 4A, and is perpendicular to the axis defined by the pin 6 but offset therefrom. A pin 12D' locks together the boss 5, the connecting member 12A and the retaining shaft 12B. A second pin 12E' passing down a vertical bore centrally of the bifurcated upper portion of the pivotal/rotary connector 4A and locked in position there by a grub-screw acts both to keep the pin 12D' securely in place and to prevent ingress of dirt. The pin 12E' stops short of the boss 5 and therefore does not interfere with rotation of the boss 5 relative to the pivotal/rotary connector 4A.

The functional difference between the first and second embodiments will be described later.

The connecting members 12A provide releasable mountings for a pair of patient upper body support means which include patient underarm support elements 13 which in use pass beneath the armpits of the patient. Each underarm support element 13 may be detached from its mounting 12A by retraction of a spring-biased retention pin 14 carried by the respective connecting member 12A, as illustrated in FIG. 4. The underarm support elements 13 may then be replaced by differently sized underarm support elements 13 to suit a differently sized patient. When connected, however, the underarm support elements 13 extend in cantilever from the pivotal/rotary connectors 4A, so that the weight of the patient's upper body acting downwardly on the said underarm support elements 13 exerts an anti-clockwise moment on the pivot pins 6 as viewed in FIGS. 3A to 4.

Suspended from, but rigidly connected to, each of the underarm support elements 13 is a side plate 15 comprising a rigid plate curved to conform to the shape of the sides of a patient's ribcage. Removably secured to the side plates 15 are a pair of side pads 16 to be described in greater detail later.

Figure 2A:
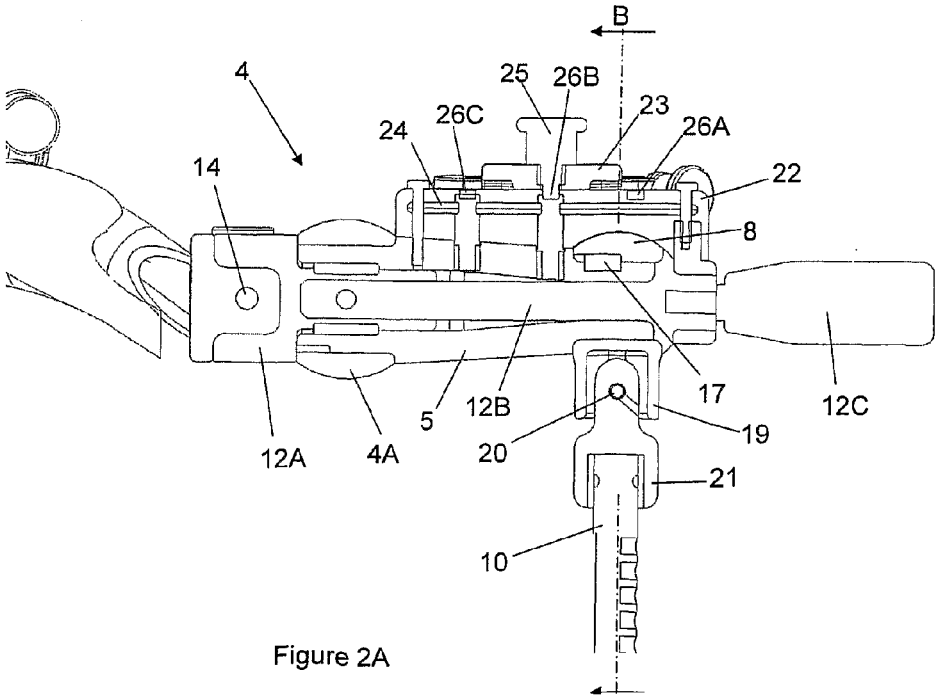
FIG. 2A is an enlarged detail of one of the suspension mountings of FIG. 2.
Figures 2B, 2C:
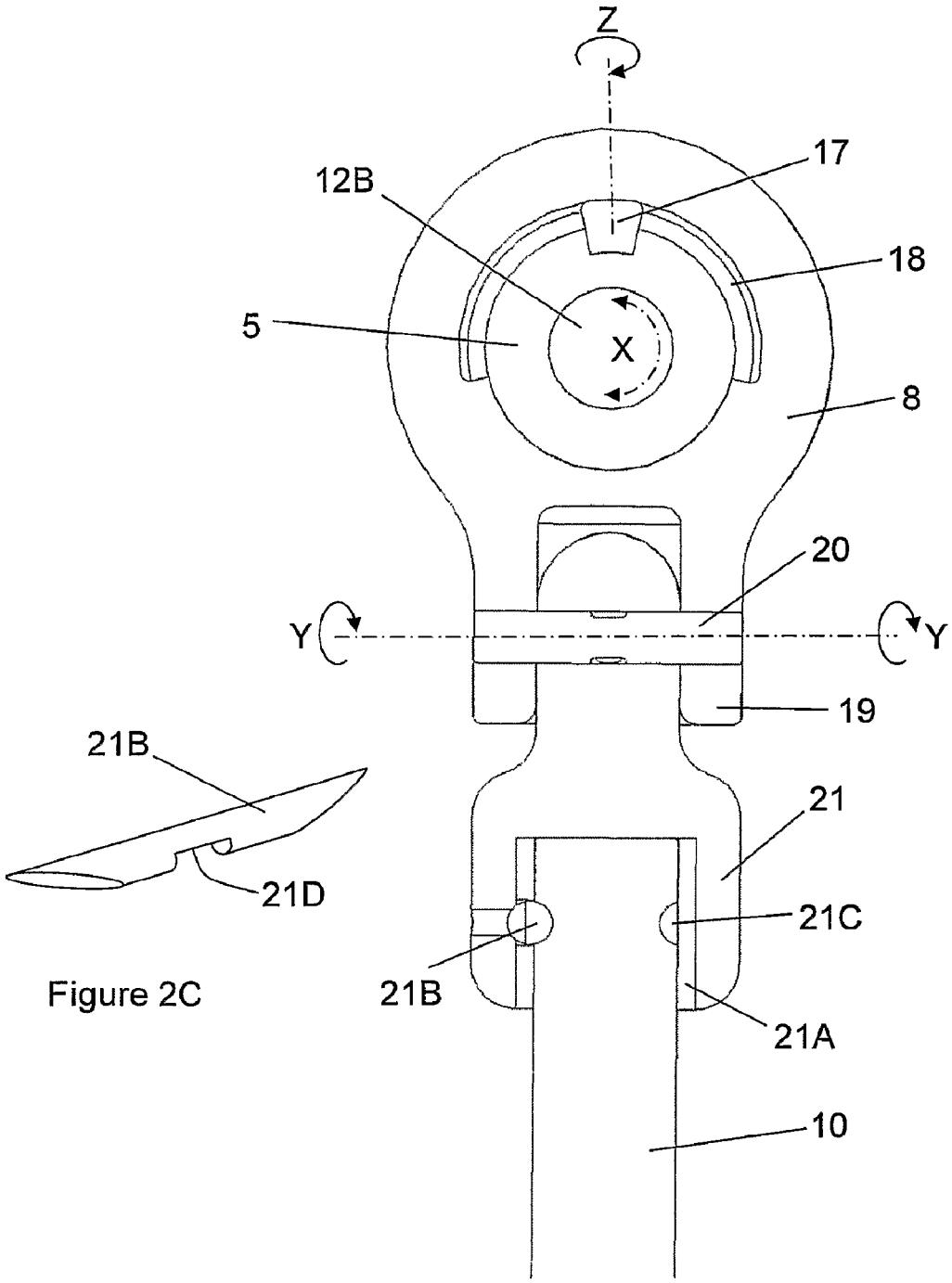
FIG. 2B is a vertical section taken along the line B-B of FIG. 2A.
FIG. 2C is a perspective view of the retaining pin of FIG. 2B.

The universal joints 8 one at each end of the link bar assembly 9, and the link bar assembly itself, permit pivotal movement of the connecting members 12A and bosses 5 relative to the link bar assembly 9 about the three mutually perpendicular axes X, Y and Z illustrated in FIG. 1. The X axis is the central axis of the boss 5 and of the retaining shaft 12B as illustrated in FIG. 2B. The pivotal movement around the X axis is limited to about 180° of movement relative to each boss 5, that limited movement being provided by a stop member 17 held by the distal end of the boss 5 and movable in an arcuate track 18 in the associated universal joint 8 as shown in FIGS. 2A and 2B, but for the embodiment of FIG. 3A there is no angular limitation to the movement of the connecting members 12A, retaining shafts 12B and underarm support elements 13, about the axis of each boss 5, so that for that embodiment a full 360° of movement is permitted of the underarm support elements 13 and their side plates 15 and side pads 16 relative to the link bar assembly 9. The stop member 17 allows a wide range of movement for both the side pads 16 and the suspension side bars 1 but prevents the whole unit from folding inside out and back to front.

Pivotal movement is also permitted between the connecting members 12A and bosses 5 and the ends of the link bar assembly 9 about the axis Y as shown in FIGS. 1 and 2B, although that range of pivotal movement is limited to about ±15° of movement by a shroud 19 which encloses a pivot pin 20 connecting together the respective universal joint 8 and either and end cap 21 of the rod 10 of the link bar assembly 9 or a bushing connection 11*b* of the cylinder 11 of the link bar assembly 9, as shown in FIGS. 2 and 2A. A greater or lesser freedom of movement can be provided by varying the axial dimensions of the shroud 19. The pivot pin 20 is retained in position by a diagonal grub-screw which engages in a waisted central portion of the pivot pin 20 as shown in FIG. 2A.

Freedom of movement of the universal joints 8 about the Z axis is through a full 360° of movement and is explained with reference to FIGS. 2B and 2C. The pivot pin 20, referred to immediately above, passes through not the rod 10 itself, but through the end cap 21. The corresponding pivot pin 20 at the other universal joint 8 passes through a bushing connection 11*b* fast to the end of cylinder 11. A phosphor-bronze bushing 21A between the end cap 21 and the rod 10 provides a smooth low friction bearing surface for rotation of the end cap 21 relative to the rod 10. The rod 10 is held captive in the end cap 21 by a hardened metal pin 21B which passes through a chordal bore in the end cap and into an annular recess 21C formed in the end portion of the rod 10. The metal pin 21B is illustrated in perspective view in FIG. 2C. It is retained in its chordal bore in the end cap 21 by a grub screw which engages a recessed central portion 21D of the pin 21B so as to retain the pin 21B securely in position. Both bosses 5, and all components directly connected to each, are therefore permitted to rotate freely around the Z axis, thereby establishing the third degree of movement of the universal joints 8. A similar freedom of movement about the Z axis would be provided if the end cap 21 were at the opposite end of the link bar assembly 9 and connected to the cylinder 11, and if the pivot pin 20 at the rod 10 end passed through the rod or through a bushing fast to the rod 10 at the other end of the link bar assembly 9.

It will be appreciated from the above description that the X, Y and Z axes do not necessarily intersect at a single point. In the illustrated embodiment the Y axis is offset from the point of intersection of the X and Z axes as shown in FIG. 1.

However each universal joint 8 and link bar assembly 9 forms a combination effective to permit pivotal movement of each of the cantilever side bar assemblies 4B relative to the link bar assembly 9 about all three mutually perpendicular axes.

Referring once again to FIG. 1, it will be seen that attached rigidly to each outer side of each boss 5 is a horizontal rail 22 along which a slider 23, (see also FIG. 2A) can be moved. A phosphor-bronze plate 24 (see FIG. 2A) in each rail 22 provides a free running and low friction track for ease of movement. A spring-loaded plunger 25 can locate in any of recesses 26A, 26B and 26C in the rail 22 to position the slider 23 at different lateral positions along the rail 22 (in FIGS. 1 and 2A the plunger is located in recess 26B to position the slider centrally on the rail 22). Each slider 23 carries a carrier 27 for a canvas seat sling for supporting the patient lower body weight.

A basic seat sling 28, shown only in FIGS. 12 to 14, is a simple U-shaped loop of fabric 28 which in use is suspended from the carriers 27 and supports the patient's lower body weight. It may have length adjusters 28A. It is easily placed beneath a patient's upper thighs or posterior simply by asking the patient to bend at the knees, whether the patient is in a sitting position or a face-up lying prone position, and then latched onto the carriers 27. When the patient is lifted (as will be described later in greater detail) the patient's lower body weight is taken by the seat sling 28 and transferred to the carriers 27. The carriers 27 are positioned forwardly of the pivot pin 6 of the suspension mounting 4, so that the moment exerted by the patient's lower body weight on the suspension mounting 4 is in an opposite sense to that exerted by the patient's upper body weight. The lower body weight acts through the carriers 27 which are supported by the boss 5 forwardly of the pivot pins 6, and the upper body weight acts through the underarm support elements 13, side plates 15 and side pads 16 which are supported by the connecting members 12A rearwardly of the pivot pins. Because the patient's body is flexible, it adjusts in posture until the moments of the upper and lower body parts are equal as well as opposite, and the angle of the bosses 5 and connecting members 12A adjusts accordingly, by pivotal movement of the suspension mountings 4 about their pins 6.

The rail 22 and slider 23 enables each carrier 27 to be adjusted to increase or decrease the cantilever extent of the patient's lower body weight acting on the suspension mounting 4. That is important if the underarm support elements 13, side plates 15 and side pads 16 are to be exchanged for smaller or larger support elements 13, side plates 15 and side pads 16 to suit differently sized patients. If larger underarm support elements 13, side plates 15 and side pads 16 are fitted, then the slider should be moved forwardly into the aperture 26A in order to balance the increased moment imposed by the patient's upper body weight on the larger and therefore more far-reaching underarm support elements 13, side plates 15 and side pads 16. For smaller underarm support elements 13, side plates 15 and side pads 16 the slider should be moved to aperture 26C.

An alternative seat sling 28' is shown in FIG. 15A which shows a third embodiment of the patient lifting frame, being a modification of the previous Figures. The modification to the frame itself lies in the fact that the rails 22, sliders 23 and carriers 27 of the previous Figures are replaced by a pair of fixed carriers 27' suspended from the universal joints 8 more or less in line with the Z axis. The carriers 27' are suspended by mounting frames 27" from end protrusions 8A formed as integral parts of the universal joints 8 (FIG. 15B), each mounting frame 27" having a spigot portion received in an upwardly extending bore 8B formed in the associated protrusion 8A and held captive by a pin or bolt inserted in an axial bore 8C. The carriers 27' thus are fixed in the sense that they are unable to be moved in the forward and back direction, as could the carriers 27 of FIGS. 1 to 15 on their sliders 23. The carriers 27' can however pivot relative to their mounting frames. The adjustment of the cantilever extent of the patient's lower body weight acting on the suspension mountings 4, by moving the carriers 27 forward or back relative to the Z axis, is therefore missing from this embodiment. An addition to the features of the earlier Figures is however a carrier 28" suspended beneath the link bar assembly 9 at approximately its central point. The carrier 28" is similar in shape to the carriers 27' and is similarly pivotable about a mounting frame carried by the link bar assembly 9. Each of the carriers 27' and 28" comprises a plunger which if pulled away from the carrier body allows insertion of a loop of webbing and when released retains that webbing in position. The seat sling 28' used in this embodiment of the invention is more than the simple U-shaped loop of fabric 28 of FIG. 12. It has a central gusset portion 28B which has stitched thereto a length-adjustable strap 28C which terminates at its top end in a loop of webbing 28D. The seat sling 28' connects at its outer sides to two length adjusting straps 28A as does the sling 28 of FIG. 12. Initially the seat sling 28' of FIG. 15A is passed under the patient's upper thighs as described above for the seat sling 28, and the length adjusters 28A hooked onto the carriers 27' and adjusted accordingly. Then the strap 28C is pulled up between the patient's legs and its end loop 28D is hooked onto the carrier 28". Finally the length of the strap 28C is adjusted for maximum patient comfort. The total seat sling makes up into a generally W-shape which maintains the patients' legs supported without either drawing them uncomfortably together or allowing them to spread uncomfortably apart.

A further optional feature of FIG. 15A, which also may with advantage be incorporated into the basic seat sling 28 of FIG. 12, is an adjustable length back support strap 28E which is sewn onto the remainder of the seat sling and which passes behind the patient slightly below the small of the patient's back in use, providing a restraint to prevent a patient from slipping backwards through the seat sling.

It has been found that patient comfort is enhanced by the use of the seat sling of FIG. 15A, and that with such a seat sling the adjustment afforded by the rails 22 and sliders 23 of the previous Figures is unnecessary. The omission, in the embodiment of FIG. 15A, of the rails 22 and sliders 23 of FIGS. 1 to 15 also enhances the appearance of the lifting frame. However if the visual appearance of FIG. 15A is desired together with the seat sling adjustability of FIGS. 1 to 15, then one possible modification (not illustrated) to the lifting frame of FIG. 15A would be for the 2-axis pivotable/rotary connector 4A to be axially adjustable along the length of the boss 5. Moving the 2-axis pivotal/rotary connector 4A forwardly along the boss 5 would transfer the balance point or pivotal axis of the suspension mounting 4 forwardly, so that the patient upper body support connecting member 12A exerts a greater moment anticlockwise as viewed in FIG. 3A and the seat sling 28 exerts a lesser moment clockwise. Only a very minor longitudinal adjustment of the connectors 4A is therefore necessary to achieve a significant change to the balance of the patient upper and lower body weights during lifting.

Some patients may need to have their heads supported during lifting from a prone position or when being lifted while in a sitting position because they have no muscular control of their necks. Therefore an optional addition to the patient lifting frame of the invention (whether the embodiments of FIGS. 1 to 15 or that of FIG. 15A) is a patient head and neck support as illustrated in FIGS. 5A to 14. The head and neck support comprises a pair of resilient upstanding posts 50 as shown in FIGS. 6A to 7, one detachably secured to the rear edge of each side plate 15. The attachment/detachment mechanism comprises a mounting member 51 detachably securable to each of the side plates 15 and a first post portion 52 axially slidable in a bore 53 in the mounting member 51 and securable in any of a number of different axial positions extending by varying amounts from the mounting member 51. The mounting member 51 carries a bolt 54 which may be withdrawn against the bias of a spring to enable the mounting member to be placed straddling and engaging an anchorage member 51A fast to the associated mounting plate 15. When the bolt 54 is released the spring causes it to pass into a bore in the anchorage member so as to anchor the mounting member 51 firmly to the side plate 15. The amount by which the first post portion 52 extends above the level of the side plate 15 can be adjusted by lifting a spring biased plunger 56 and moving the first post portion 52 axially in its bore 53 and then releasing the plunger so that it engages in an appropriate one of a number of blind bores 55 formed in the side of the first post portion 52 (see FIG. 7).

At the distal end of the first post portion 52 is a second post portion 57 pivotally mounted to the first post portion 52 and a spring 58 surrounding the pivotal connection and compressed between two shoulders 59 and 60, one formed on the first post portion 52 and the other formed on the second post portion 57. The resilience and the compression of the spring 58 form a resilient means urging the second post portion 57 to assume a co-linear relationship with the first post portion 52. However the second post portion 57 is able to tilt from side to side (but not forwardly or rearwardly) relative to the first post portion 52 against a resilient bias. In use, the posts 50 are both mounted on the anchorage members 51A at the rear edge portions of the side plates 15 and then the second post portions 57 are inserted into side pockets 61 of a head cushion support 62 which is shown most clearly in FIG. 8. The head cushion support 62 is a looped length of canvas carrying on a front face 62A a neck cushion 63 and optionally a head cushion 63A (see FIG. 15A) sewn in position, and having on its rear face 62B elasticated webbing 62C for drawing the canvas into its looped configuration to define the two pockets 61 into which the second post portions 57 are received. The width of the looped length of canvas can be varied by adjusting the length of the elasticated webbing 62C using a friction buckle (not shown). A forehead strap 64 is attached at its ends to the canvas at a level above that of the cushion 63, and includes a tightening friction buckle 65 which enables the strap to be tightened around a patient's forehead in use. FIG. 11 illustrates the method of using the head and neck support. The extension of the first post portions 52 is adjusted to the correct height for the patient, and then the patient's head is placed over the neck cushion 63 while the forehead strap 64 is tightened. Thereafter the patient may be lifted in the normal manner, and any violent movement of the patient's shoulders, caused for example by a seizure or fit or by an affliction such as Parkinson's disease, is communicated by the posts 50 and the cushion support 62 to the patient's head which therefore moves in unison with the shoulder movement, maintaining generally constant alignment of the top vertebrae of the patient's spine. The head and neck support can of course be removed completely whenever the patient has a stable muscular control of head movement. If desired the first post portions 52 may be provided with a protective covering, such as a corrugated rubber sheath as shown in FIGS. 11 to 14. A similar protective covering 10', 11' may if desired be placed around the link bar assembly 9 (see FIG. 15A).

A slightly more advanced design of lifting frame is shown in FIG. 15C. In comparison to the lifting frame of FIG. 15A, the carrier 28" is able to receive the hanging loop 28D of the seat sling 28 from either the right hand or the left hand side. The rod 10 of the link bar assembly 9 has a ratchet profile so that the handles 12C can be simply pushed together to shorten the length of the link bar assembly 9. The lock button 11A then becomes simply a release button which is lifted to release the ratchet engagement. FIG. 15C shows the protector 10', 11' removed, the better to show the construction of the self-locking ratchet mechanism of the link bar assembly 9, but in use of course it shrouds the link bar assembly as shown in FIG. 15A.

FIG. 15C shows simpler slot-in carriers 27A in substitution for the carriers 27' and mounting frame 27" of FIG. 15A, and the anchorages 30, 32, 34 and 34' and guide 31 on the side plates 15 are moved further to the front of the side plates 15 than in FIG. 15A. Also the bottom corners of the side plates 15 are more rounded in the design of FIG. 15C than in that of FIG. 15A. The side plate edges also have a curved profile to enable the straps 29,33 to slide easily across. Strap guide pins 32A are located on both side plates 15 towards the rear edge to guide the strap 29 safely in between then and prevent the strap 29 from slipping off either of the side plates 15.

Finally FIG. 15C shown an optional addition which is a back, head and neck support plate 49 which is a semi-rigid shaped plate which can be positioned between the patient's upper back and the top strap 33, to provide an additional element of support to a patient's back neck and head during lifting. If desired, the plate 49 may be designed with a cushioned head and neck support portion; or alternatively it may be shaped and sized to support and protect only the patent's back, with the head and neck support portion being omitted.

Firm contact between the side pads 16 and the opposite sides of the patient's ribcage is established by one or both of two systems. In all cases both straps 29 & 33 are passed around the patient and around the side plates 15 and side pads 16. Those straps are illustrated in FIGS. 11 to 15. A lower strap 29 is connected to an anchorage 30 on one side plate 15, passed behind the patient's back, through a guide 31 on the opposite side plate 15 and connected to another anchorage 32 on the first side plate 15 before being tightened by pulling an end of the strap against a conventional fastener. As the strap is tightened so the side pads 16 and side plates 15 are drawn into tighter contact with the patient's ribcage. Excessive tightening is undesirable. An upper strap 33 passes only behind the patient and is anchored at its opposite ends to anchorages 34 positioned one on each of the side plates 15.

The straps are further illustrated in FIGS. 17 to 20. The top strap 33 of FIG. 17 comprises an anchorage end 35 carrying a buckle 36, and an adjustable end 37 which extends from a pulling loop 38, through a loose fabric sleeve 39, through the buckle 36 and back to a second anchorage end 40. Each of the anchorage ends 35 and 40 comprises a looped end portion 41 which can be placed over an associated anchorage 34 on one or other or both of the side plates 15. The straps 33 and 29 of FIGS. 17 and 20 with their looped ends 41 and 41' are suitable for hooking over the anchorages 30, 32 and 34 of FIGS. 10, 12 and 13 in which a spring-loaded plunger keeps each looped end captive in the anchorage. The anchorages of FIGS. 15A and 15C have no spring-loaded plunger, and the strap is retained in place solely by the shape of the slot in the anchorage and the stiffness of the strap. To make the strap easy to fit and yet secure against inadvertent release from the anchorage, the ends of straps 33 and 29 for use with the anchorages 30, 32, 34 and 34' of FIGS. 15A and 15C are preferably formed not with looped ends 41 and 41' as shown in FIGS. 17 and 20 but with a solid end profile as shown in FIG. 20A. That end profile may be formed by wrapping the strap end around a solid core before folding it back on itself and sewing, or by some form of fusion of the strap and. For example, the strap 29 or 33 may be formed of a flexible low-friction fabric-reinforced plastic sheet, with the plastic being moulded or stitched into an integral cylindrical stop portion 41A at its ends. The stop portion 41A cannot pull back through the sot in the anchorage 30, 32, 34 or 34', so the anchorage is secure. The bottom strap 29 as shown in FIG. 20 is of similar construction except that the strap 29 is much longer because the strap in use extends completely around the patient. The component parts of the bottom strap 29 are therefore shown with the same reference numerals as those of the top strap of FIG. 17, but with primes added. FIG. 18 is a perspective view of the buckle 36 of FIG. 17 (or the buckle 36' of FIG. 20) and FIG. 19 is a side sectional view of that buckle showing the passage of the strap around a guide bar 42 and beneath an anchorage blade 43. The loop 38 of the strap is pulled to tighten the strap across the patient's body and draw together the side plates 15 and side pads 16 against the sides of the patient. With the strap in tension the buckle is pulled down flat by the strap, and the blade 43 keeps the strap taught and prevents it from relaxing. To relax the tension, the handle 44 is simply raised, which releases the pressure of the strap on the blade 43 and allows rapid slackening of the strap. Once the strap is slackened, its ends can be released from the anchorages 30, 32, 34 or 34'.

The straps 29, 33 must first be passed behind the patient before their ends can be anchored to the side plates 15. Indeed the straps 29, 33 may be placed in position behind the patient's back before the support frame is swung into position, and only then connected to the anchorages 30, 32, 34 or 34' of the support frame. Whenever the straps 29, 33 are positioned behind the patient, however, the action is facilitated by the use of a pusher bar 45 as illustrated in FIG. 16. The pusher bar is a thin bar of rigid material but flexible, such as a flat steel or reinforced industrial grade plastics blade optionally coated with a low friction surface coating. One end of the blade 45 is formed as a narrow projecting tongue 46 co-planar with the rest of the blade 45. That tongue is in use inserted in a pocket 47 or 47' stitched in one end of the appropriate strap 29 or 33. The four pockets 47 or 47' shown in FIGS. 17 and 20 are identical, but possibly the clearest to understand is that illustrated at the left hand side of FIG. 20. The pocket 47' receives the tongue 46, and the shoulders on opposite sides of the tongue 46 prevent its passage further into the pocket so that the blade 45 can be used to slide each strap in turn beneath the back of a patient lying flat, or behind the back of a sitting patient. The patient does not have to be manually lifted to pass the strap behind him or her, and once the strap has emerged at the remote side of the patient, it can be pulled through and anchored by its looped end 41'. Consider the top strap 33 of FIG. 17. Normally it would be passed behind the patient from right to left as the lifting frame is viewed in FIG. 1, with the pusher blade 45 inserted in the pocket 47 at the left hand end of the strap as illustrated in FIG. 17. If the patient were to be lying against a wall then there might not be room to manipulate the pusher blade 45 from the right, and it would then be necessary to pass two thicknesses of the strap behind the patient from the left, those two thicknesses being the pulling loop 38 and the free end 40 as illustrated in FIG. 17. To achieve that, the free end 40 of the strap 33 is provided with a reinforced slit 48, and the tongue 46 of the pusher blade 45 is passed first through the slit 48 and then into the pocket 47, so that both ends of the strap 33 can be pushed together behind the patient, even from the left hand side of FIG. 1. It is desirable to have the strap 33 of a length such that the buckle does not lie behind the patient's back. To accommodate that for all patients, the strap 33 is preferably tightened from the front of the patient and not from the back as shown in FIG. 12. Also the end of the strap 33 remote from the buckle 36 is preferably provided with a series of alternative anchorage points for connection to the anchorage 34 of FIG. 15C.

The handles 12C are particularly useful at this stage of connecting the patient lifting frame around the patient's upper body. The top and bottom straps 33, 29 are in position. The top strap 33 in particular tends to draw the side plates 15 and side pads 16 together at the back of the patient so that they tend to splay apart slightly at the front of the patient particularly at the upper ends of the side plates 15 and side pads 16. The nurse, healthcare staff or carer strapping the patient into the support frame is at this stage able to push together the two handles 12C to draw the side plates 15 together at their upper front corners against the restraint of the top strap 33, until the side pads 16 are in a more uniform contact with the patient's sides. At this stage the lock button 11 a can be rotated through 90°, which is sufficient to release it from its withdrawn (unlocked) condition. It is then spring-biased to find a location in one or other of a number of blind recesses 10*a* formed in the rod 10 of the link bar assembly 9, to maintain that uniform contact of the side pads 16 against the patient's sides.

The tightening of the straps 29 and 33, and the adjustment of the length of the link bar assembly 9, is alone sufficient to hold the side plates 15 and side pads 16 against the patient's ribcage in the first embodiment of the invention as illustrated in FIGS. 3A and 5A. The carriers 27 for the seat sling 28 are held at opposite sides of the boss 5 by the pin 12E and the boss cannot rotate relative to the pivotal/rotary connector 4A. The side pads 16 and side plates 15 are however freely rotatable relative to the bosses 5, and can be drawn against the sides of the patient by the straps alone. It will be observed in FIG. 5A that the carriers 27 remain horizontally at the same level on opposite sides of the bosses 5 whereas the side plates 15 are swung inwardly in a direction to grip against the sides of the patient.

In the second embodiment of the invention, as illustrated in FIGS. 3B and 5B, the bosses 5 and side plates 15 are connected to rotate together and the bosses are rotatable relative to the pivotal/rotary connector 4A. The patient's lower body weight acting through the seat sling 28 on the carriers 27 therefore increases the pressure of the side plates 15 and side pads 16 against the patient's ribcage to a relatively minor but significant and effective extent, so that as the patient is lifted he or she feels additional pressure and support on the lower torso, which imparts considerable patient confidence in the ability of the support frame of the invention to bear the patient's weight. It will be observed in FIG. 5B that the rails 22 and the carriers 27 rotate with the side plates 15, so that the patient's lower body weight acting on the carriers also presses the side plates 15 and side pads 16 against the patient's sides. The small but significant amount of additional pressure can be changed as part of the design of the patient support frame, by varying the radial offset of the sliders 23 on their rails 22, relative to the axes of the bosses 5.

The side pads 16 are removable from their side plates 15 as illustrated in FIG. 10. The means for removably attaching the side pads 16 to their side plates 15 may be an array of studs extending from the side plates 15 as shown in FIG. 10, receivable in apertures in the side pads 16; or it may be simply the cooperating shapes of the side pads 16 and side plates 15. For example the side pads may extend partially around the side plates, with a flexible but firm retention rim passing behind each side plate 15 to secure the side pads 16 in place. The reason for the side pads 16 is patient comfort. The reason for their removability is to enable the side pads 16 to be regularly cleaned, disinfected, or replaced, which is particularly important in a hospital or medical environment. If desired, disposable fabric elasticated covers can be provided to cover the side pads 16 in use to maintain cleanliness in a hospital environment.

FIGS. 10A and 10B illustrate a preferred shape for the side plates 15 and side pads 16, designed to make the removal and cleaning of the side pads 16 easy. Each side plate 15 has a pair of vertical rails 15A extending on the inside of the side plate 15 in a direction towards the patient ribcage in use. Because of the curvature of the side plates 15 the rails 15A are inclined together when seen in horizontal section. Each side pad 16 has a pair of cooperating grooves 16A and is formed at its top end with a moulded portion 16B which hooks over the associated underarm support element 13 to which the side plates 15 are attached. To attach the side pads 15 of FIG. 10B to the side plates of FIG. 10A, all that is necessary is to slide the pads down the inside of the side plates with the rails 15A engaging in the grooves 16A, until the top moulded portion 16B hooks over the underarm support element 13. The angle between the rails 15A holds the side pads 16 in place. To remove them, the same sliding movement is performed in reverse.

FIGS. 11 to 14 illustrate the way in which the patient lifting frame can be used to lift a patient from a prone face-up lying position. That lifting operation may be from one bed to another or from the floor to a bed, in which case the patient remains in the prone face-up lying position throughout the lifting operation; or it may be to raise a patient from a prone face-up lying position to a sitting position. It will be understood that the lifting frame can be lowered into position over a prone patient from the spreader bar of an invalid hoist. The universal joints 8 enable the frame to be manipulated so that first one of the underarm support elements 13 of the patient upper body support means can be placed underneath one of the patient's armpits, and then the other can be placed beneath the other of the patient's armpits. The straps 29 and 33 are then used to tighten the side pads against the patient's sides as previously described.

If the patient is to be lifted from one bed to another, then during that lifting operation the pivotal movement of the 2-axis pivotal/rotary connectors 4A relative to the suspension side bars 1 is inappropriate. The kinematic locks are provided to lock those components in axial operation the 2-axis pivotal/rotary connectors 4A must be maintained at substantially 90° to the suspension side bars 1, in the relative positions shown in FIG. 11. In this condition the suspension side bars 1 are generally vertical and the side pads 16 are generally horizontal. To maintain that patient orientation the seat sling 28 is detached and replaced by a temporary sling (not illustrated) for the patient's legs which is suspended directly from multiple auxiliary spreader bars suspended directly from the lifting hook of the hoist. The use of multiple spreader bars, commonly used when lifting patients with spinal injuries using conventional slings, enables the load of the patient's lower body to be distributed evenly. Preferably the head and neck support of FIGS. 6 to 10 is used in conjunction with such a lifting operation, so that patients with spinal injuries can be transferred in the prone position from one bed to another whilst providing proper spinal support throughout the operation. The lifting operation is far easier than trying to move patients using slings only, because the patient does not have to be rolled onto the sling as with conventional sling-only lifting operations. The sling used in conjunction with the lifting frame of the invention in connection with this lifting operation needs only to be slid under the patient's legs up to and preferably under the buttocks, and this can be achieved without undue disturbance of the patient's rest position and with no spinal disturbance. The side pads 16 and side plates 15 take the weight of the patient's upper body, and the head and neck support takes the weight of the patient's head, all without having to roll the patient from side to side.

If a patient is to be lifted from a prone face-up lying position to a sitting or standing position, then as with the prone-to-prone lifting operation just described, the lifting frame can be lowered into position over a prone patient from the spreader bar of an invalid hoist. As before, the universal joints 8 enable the frame to be manipulated so that first one of the underarm support elements 13, side plates 15 and side pads 16 of the patient upper body support means can be placed underneath one of the patient's armpits, and then the other can be placed beneath the other of the patient's armpits (or both together). The straps 29 and 33 are then tightened as previously described. For a prone-to-sitting or prone-to-standing lifting operation, the seat sling 28 is preferably detached during this early manipulation. The seat sling 28 (not shown in FIG. 11) may then be placed in position by raising the patient's knees from the bed or floor on which he or she is lying. Even the initial tightening of the seat sling length adjusters 28A causes some of the patient's lower body weight to be transferred to the forward end of the cantilever side bar assembly 4B, so that as soon as lifting takes place using the lifting hoist, the patient is balanced with his or her upper body weight being taken by one end of the cantilever side bar assembly 4B and his or her lower body weight being taken by the other end of the cantilever side bar assembly 4B. Rotation of the cantilever side bar assembly about its pivot pin 6 causes the patient's weight to be distributed with equal and opposite moments being applied to the pivot pin 6 of each of the cantilever side bar assemblies 4B. The patient can then be raised using the hoist, and during that raising towards the sitting position, progressively more of the patient's weight is transferred to the seat sling 28, so that throughout the raising the patient is balanced about the pivot pins 6. The universal joints 8 are of benefit in initially placing the frame around the patient's body, because they enable the opposite side plates 15 and side pads 16 to be placed beneath the patient's armpits one at a time or both together. During the lifting operation, the universal joints 8 are of even greater benefit because the patient can move relatively freely within the frame and has the sensation of being firmly supported while not being encased in an uncomfortable rigid framework. If the patient were to twist, turn or convulse during lifting, then all of the movement of the patient's upper body would be accommodated by the flexure of the upper body support frame around the universal joints 8, which combines to the optimum degree the benefits of patient dignity, comfort and safety.

Some patients may need to have their heads supported during lifting from a prone to a sitting position because they have no muscular control of their necks. FIG. 11 shows the patient head and neck support in position, with the patient's head being firmly secured to the cushion support for the back of the patient's head using the forehead strap.

FIG. 15 shows how the lifting frame can be used as a walking aid, for example in physiotherapy following an accident. For this exercise, the kinematic locks are used to prevent rotation about the pivot pins 6, by pushing the sleeves 7 downwardly over the 2-axis pivotal/rotary connector 4A. The seat sling 28 is then removed. During walking exercises, the flexibility of movement of the patient upper body support frame, by flexure around the universal joints 8, is of very great importance. The link bar assembly 9 can pivot forwardly or rearwardly and upwardly or downwardly about each universal joint 8, which gives maximum therapeutic benefit to the walking exercises by combining the movement of the patient's legs with the natural flexure of the rest of the patient's upper body as with natural and unassisted walking Although not illustrated, a later stage of walking therapy can involve fitting the support frame to the patient's upper body back to front, so that the link bar assembly 9 lies behind the patient and the side bars 1 are out of reach of the patient's hands. This forces the patient to walk without holding on to the side bars 1. Of course, in this reversed position the patient seat sling 28 cannot be used, and the kinematic locks must be engaged so as to prevent any pivotal movement of the cantilever side bar assembly about its pivot pin 6. Even in this reversed position, however, the universal joints 8 are of the utmost benefit in that they allow full patient mobility, with the patient's upper torso, back, arms and shoulders being able to move unrestricted to balance movement of the patient's legs without diminishing the support which the support frame gives to the patient or the patient confidence in that support.

The universal joints 8 also have a very significant practical benefit in that they enable the patient lifting frame to be packed flat for storage and transportation. Consider first the frame spread out flat as in FIG. 21 on a floor or table. The side pads 16 have been removed from the side plates 15. It was mentioned earlier that the main bosses 5 have a limited range of movement of only 180° relative to the universal joints 8. The laid out flat condition of FIG. 21 represents one limit of that range of movement. The left hand suspension side bar 1 is then moved to place it across the centre of the laid out frame as shown in FIG. 22, the associated boss 5 turning through 180° to its opposite limit of movement. The left-hand side underarm support element 13 and its attached side plate 15, which are pivotable independently of the side arm 1, are also moved to the central position as shown in FIG. 23. By moving the right hand suspension side bar 1 from the position shown in FIG. 22 to the position shown in FIG. 23 (which movement is made easier by first locking the kinematic lock on that suspension side bar) and rotating the right hand side underarm support element 13 and its associated side plate 15 to the position shown in FIG. 23, this folding movement is made more easy. The folding operation can be completed by lowering the left hand suspension side bar 1 to the position of FIG. 24. The folded up upper body frame can then easily be packed for storage or for transportation.

The lifting frame of the invention may be provided with a cleaning system for the straps. If the straps are made of a low friction flexible internally reinforced plastic sheet material as described above for FIG. 20A, then the cleaning may be simply by wiping a suitable cleaning solution over the surface of the straps.

Straps made of fabric webbing may require specialist cleaning A practical detail which is very advantageous is that such straps can be systematically coded, for example using bar codes or other means, so that when they are removed for cleaning they can be identified and returned to the same lifting frame with which they have previously been used. That is of value in a hospital environment when it is desired to ensure that each set of straps is, after cleaning, returned to the same ward from which it originates. Missing straps can thus be identified, and losses prevented. Also the sytematic coding is useful to keep track of the number of times a set of straps has been used, with a view to replacing them at the end of their recommended lifetime. For example a bar code on each strap may be scanned after each use or at the end of each day or week of use, and a computer may inform the user on when specialist cleaning is advised. That same act of scanning the bar coded straps enables a hospital of large nursing home to keep a log of where the sets of straps are at any one time, so the loss of straps can more easily be prevented. Preferably the straps are stored together in groups of four (one top strap 33, one bottom strap 29, one seat sling strap 28 or 28' and one forehead strap 64 (see FIG. 8) and are preferably kept together in a purpose-designed rack (not shown). so that the complete set is always available.

When each complete set is sent for cleaning, that may be in a sealed and coded bag to ensure that the cleaned sets of four straps are returned to their required locations. Legislation may require the lifting hoist to have an automatic counter which counts the number of patients lifted by the hoist, as a means of ensuring proper regular maintenance. The same technique can be used within the lifting frame of the invention, with a small counter automatically counting the number of lifts between safety checking or maintenance intervals. If a particular coded set of straps is uniquely matched to a particular lifting frame, then that counter is also a means of counting the number of times the straps have been used to lift patients.

I have also provided a customized carrying case for the lifting frame of the invention. The carrying case 70, shown in FIG. 25, has a foam insert with cut out portions for the different elements of the lifting frame. Cut into the deepest part of the foam is a space 71 for a nylon bag containing the folded straps 29 and 33. Also cut into the foam is a recess 72 for the patient lower body seat sling 28.

Cut to a lesser depth in the foam of the carrying case 70 is a shaped recess 73 which receives the folded upper body frame of FIG. 24. To the right of that recess 73 is a rectangular recess 74 for receiving the two side pads 16 or a range of differently sized side pads and their side plates together with a bottle of disinfectant or a pack of disinfectant wipes for nursing, healthcare workers or care staff to wipe down the frame, and in particular the foam side pads 16, prior to use. Dilute sodium hypochlorite is a suitable disinfectant. In a vertical slot 75 at the back of the foam filling the case 70 there may be stored the rigid but flexible pusher bar 45 of FIG. 16, and in a vertical slot 76 at the front there may be stored the head and neck support posts (52,57), together with the mounting members 51 of FIGS. 6A to 7. The head cushion support 62 of FIG. 8 can easily be stored in the recess 73, which may (although not shown in FIG. 25) be shaped to provide a clear location for that head cushion support 62.

FIG. 26 shows a wheeled trolley for storing the lifting frame of the invention and for moving it around for example between patients or between wards in a hospital environment. The trolley 90 is provided with two support hooks 91 for the suspension shackles or braids 2 of the lifting frame, so that it may be suspended securely on an upper part 92 of the trolley when not in use. It may be preferred to engage the kinematic lock sleeves 7 when hanging the frame on its support hooks 91, to provide a slightly greater rigidity of the frame during the hanging operation (although they are shown as disengaged in FIG. 26). The pusher bar 45 or a number of such pusher bars 45 may be also supported on the hooks 91 and 94. Storage hooks 91 as seen on the trolley 90 may also be of use in a basic wall frame unit (not shown) for quick and easy storage within wards when not required or for spare units. A cupboard 93 at the bottom of the trolley 90 is provided to house any spare (i.e. differently sized) side plates 15 and side pads 16, and the cushion support 62 and neck cushion 63 of the patient head and neck support system. Cleaning equipment can also be stored in the cupboard 93, together with any other relevant materials required such as the systematic coding system referred to above.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A patient lifting frame for use with an invalid hoist for lifting and supporting an invalid patient, comprising a pair of suspension side bars each of which has an upper end portion and a lower end portion and each of which is provided at its upper end portion with a linkage for connection to a spreader bar of the invalid hoist and at its lower end portion with a suspension mounting to which is attached or attachable:

a pair of patient upper body support means which together comprise a pair of underarm support elements for passing beneath the armpits of the patient and a pair of padded side plates, connected one to each of the underarm support elements of the patient upper body support means, for engaging against opposite sides of the patient's ribcage; and a patient lower body support means for engaging and supporting the posterior or upper legs of the patient;

the suspension mountings being connected together by a link bar assembly; and wherein each end of the link bar assembly is connected to an associated one of the suspension mountings through a universal joint, each universal joint and link bar assembly combination being such as to permit pivotal movement of the associated suspension mounting relative to the link bar assembly about three mutually perpendicular axes.

2. A patient lifting frame according to claim 1, wherein each suspension mounting comprises a 2-axis pivotal/rotary connector pivotally connected to the associated suspension side bar;

a cantilever side bar assembly rotatably connected to the 2-axis pivotal/rotary connector; and wherein the patient upper body support means are connected to the cantilever side bar assemblies and each extends rearwardly in cantilever from the associated 2-axis pivotal/rotary connector, and the patient lower body support means are connected to the cantilever side bar assemblies and each extends forwardly in cantilever from the associated 2-axis pivotal/rotary connector, so as to impart equal and opposite moments about the pivotal axes of the 2-axis pivotal/rotary connectors when a patient is lifted using the patient lifting frame.

3. A patient lifting frame according to claim 2 wherein the pivotal connection between each 2-axis pivotal/rotary connector and its associated suspension side bar is releasably lockable to be held at a fixed angle with each cantilever side bar assembly generally perpendicular to its associated suspension side bar.

4. A patient lifting frame according to claim 3, wherein to achieve the releasable lockability of the pivotal connection between each 2-axis pivotal/rotary connector and its associated suspension side bar, there is provided a sleeve axially slidable on each suspension side bar between a lock releasing condition in which it is clear of the 2-axis pivotal/rotary connector and a locking condition in which it surrounds the 2-axis pivotal/rotary connector and prevents pivotal movement between the 2-axis pivotal/rotary connector and its suspension side bar.

5. A patient lifting frame according to claim 2, wherein the patient lower body support means comprises a seat sling for supporting the patient's upper thighs or buttocks.

6. A patient lifting frame according to claim 5, wherein outer ends of the seat sling are attached to the cantilever side bar assemblies through seat sling carriers mounted forwardly of the pivotal axes of the respective 2-axis pivotal/rotary connectors and laterally outwardly of the rotary axes of the cantilever side bar assemblies.

7. A patient lifting frame according to claim 6, wherein each seat sling carrier is mounted on a rail fast to the associated cantilever side bar assembly and is movable forwardly and rearwardly on that rail to vary the cantilever moment which during lifting is applied by the patient's lower body weight on the cantilever side bar assemblies.

8. A patient lifting frame according to claim 6, wherein a central portion of the seat sling is supported by a strap which attaches to a seat sling carrier suspended from a central portion of the link bar assembly.

9. A patient lifting frame according to claims 5, wherein an adjustable length back support strap is sewn onto the seat sling, to pass behind the patient's back in use, providing a restraint to prevent a patient from slipping backwards through the seat sling.

10. A patient lifting frame according to claim 1, wherein the link bar assembly is adjustable in length and can be easily locked at different length adjustments to vary the distance between the two universal joints.

11. A patient lifting frame according to claim 1, wherein each of the patient upper body support means is demountable from its associated suspension mounting, enabling different sized patient upper body support means to be substituted to compensate for differently sized patients.

12. A patient lifting frame according to claim 1, further comprising an adjustable strap extending from one of the side plates of the patient upper body support means, around the back of the patient to the other of the side plates;

a second adjustable strap extending from one of the side plates of the patient upper body support means, around the back of the patient and through a strap guide in the other of the side plates and passing around the patient before being connectable to the said one of the side plates; and wherein both the straps being effective when tightened to draw the padded side plates in against the opposite sides of the patient's ribcage.

13. A patient lifting frame according to claim 12, further comprising a pusher bar of a thin rigid but flexible material having one end formed to engage a pocket in an end or ends of the strap or straps, to push the strap or straps behind the back of a sitting patient or beneath the back of a patient lying in a prone face-up condition prior to attachment of the ends of the strap or straps to the side plates and tightening of the strap or straps, the engagement of the end of the pusher bar being releasable from the pocket of the associated strap by reversal of the direction of movement of the pusher bar.

14. A patient lifting frame according to claim 12, further comprising patient head and neck support means comprising a back, head and neck support plate for insertion between the back of a patient and the straps.

15. A patient lifting frame according to claim 12, further comprising patient head and neck support means comprising a pair of resilient upstanding posts one detachably secured to a mounting at a rear edge of each of the side plates, respectively, a head cushion support for the back of the patient's head connected between distal ends of the two posts, and a forehead strap connected across the head cushion support for tightening across the patient's forehead to stabilize the position of the patient's head on the head cushion support.

16. A patient lifting frame according to claim 15, wherein each resilient upstanding post comprises a mounting member detachably securable to the mounting at the rear edge of each of the side plates, respectively , a first post portion slidable in a bore of the mounting member and securable at any of a range of positions extending by different amounts from the mounting member, a second portion attached to a distal end of the first portion, and resilient means permitting the second portion to tilt from side to side relative to the first portion against a resilient bias, to maintain the two second portions mutually parallel in use.

* * * * *